US012285056B2

(12) United States Patent
Xu

(10) Patent No.: US 12,285,056 B2
(45) Date of Patent: Apr. 29, 2025

(54) SHAPEWEAR HAVING RUBBER ELASTIC FABRIC

(71) Applicant: Xiamen Hexin Technology Co., Ltd., Fujian (CN)

(72) Inventor: Zhennan Xu, Fujian (CN)

(73) Assignee: Xiamen Hexin Technology Co., Ltd., Xiamen (CN)

( * ) Notice: Subject to any disclaimer, the term of this patent is extended or adjusted under 35 U.S.C. 154(b) by 7 days.

(21) Appl. No.: 18/295,240

(22) Filed: Apr. 3, 2023

(65) Prior Publication Data

US 2024/0196998 A1 Jun. 20, 2024

(30) Foreign Application Priority Data

Dec. 16, 2022 (CN) ..... 202211622982.9

(51) Int. Cl.
*A41C 1/04* (2006.01)
*A41D 27/02* (2006.01)
*A41D 31/18* (2019.01)

(52) U.S. Cl.
CPC ..... *A41C 1/04* (2013.01); *A41D 27/02* (2013.01); *A41D 31/185* (2019.02); *A41B 2400/38* (2013.01); *A41D 2400/38* (2013.01)

(58) Field of Classification Search
CPC .. A41C 3/02; A41C 3/04; A41D 27/02; A41D 2400/38; A41B 2400/38
USPC ..... 450/117
See application file for complete search history.

(56) References Cited

U.S. PATENT DOCUMENTS

| | | | | | |
|---|---|---|---|---|---|
| 2,335,751 | A * | 11/1943 | Friedman | A41B 9/06 | 2/73 |
| 3,357,435 | A * | 12/1967 | Enrico | A41C 1/10 | D2/714 |
| 5,255,393 | A * | 10/1993 | Brady | A41B 9/14 | 450/131 |
| 5,915,531 | A * | 6/1999 | Hilpert | A41D 1/21 | 450/155 |
| 8,647,168 | B2 * | 2/2014 | Anvaripour | A41C 1/003 | 450/74 |
| 11,457,671 | B2 * | 10/2022 | Solano | A41C 1/10 | |
| 2008/0134409 | A1 * | 6/2008 | Karasina | A41D 1/04 | 2/243.1 |
| 2008/0244805 | A1 * | 10/2008 | Griffin | A41D 1/22 | 450/95 |
| 2011/0003533 | A1 * | 1/2011 | Caruso | A41B 9/06 | 450/11 |

(Continued)

*Primary Examiner* — Jocelyn Bravo

(57) ABSTRACT

The present invention relates to a shapewear having a rubber elastic fabric. The shapewear has a one-piece garment structure or a waist-shaping trousers structure, with more than one shaping portion. The shapewear includes a shell fabric and a lining fabric; the lining fabric is stitched and connected to an inside of the shell fabric; and the shaping portions are each disposed on the lining fabric. The rubber elastic fabric has the thickness of 0.3 mm-0.6 mm, with an elastic base fabric firmly binding to rubber to achieve durability and undeformability without binding failure after machine washing; and the rubber elastic fabric has a soft hand feel and can be in direct contact with the skin, and meanwhile, the feel of heaviness can be reduced to achieve an ultralight and ultrathin feel. Furthermore, air vents are provided in the rubber fabric to ensure breathability and comfort.

17 Claims, 29 Drawing Sheets

(56) References Cited

U.S. PATENT DOCUMENTS

| | | | | |
|---|---|---|---|---|
| 2011/0214216 | A1* | 9/2011 | Zarabi | A41D 1/00 2/69 |
| 2012/0060253 | A1* | 3/2012 | Bergin (Nee Madonna) | A41C 1/003 2/69 |
| 2012/0129425 | A1* | 5/2012 | Bevans | A41D 1/06 450/11 |
| 2015/0208734 | A1* | 7/2015 | Callahan | A41D 1/22 450/30 |
| 2015/0257454 | A1* | 9/2015 | Johnson | A41C 1/02 450/11 |
| 2016/0015088 | A1* | 1/2016 | Hendrickson | A41C 1/06 450/95 |
| 2017/0027240 | A1* | 2/2017 | McClean | A41D 1/14 |
| 2021/0153573 | A1* | 5/2021 | Shams | A41D 7/00 |
| 2024/0108085 | A1* | 4/2024 | Shams | A41C 1/06 |

* cited by examiner

SHAPEWEAR HAVING RUBBER ELASTIC FABRIC

BACKGROUND OF THE INVENTION

Technical Field

The present invention relates to the technical field of shapewear, and in particular, to a shapewear having a rubber elastic fabric.

Description of Related Art

In order to highlight feminine curves, the clothing industry have developed a variety of corsets, corset trousers and other products, which generally have a main body formed by cutting and splicing an elastic fabric and capable of binding up the body, and which support or tighten sagged skin in combination with the design of sewing positions and directions, in order to create a beautiful and well-proportioned body. For example, the corsets focus on shaping the flanks on both sides and the abdomen, and the corset trousers focus on lifting the hips and binding up the belly to help a wearer bind up the fat and shape beautiful curves, as described in documents such as Chinese Patent Publication No. CN200953842Y and CN203040708U.

The elastic fabric is generally made of a nylon-polyurethane elastic mesh and other knitted fabric containing polyurethane, but is prone to deformation and reduced binding-up force after several water washing and usage for a period of time. To this end, there appeared on the market a multilayer rubber structure, in which a skin-fit fabric layer and an elastic shell fabric are compounded and pasted to the inside and outside of a rubber layer by means of glue respectively, in order to improve the wear experience during shaping. However, one the one hand, the glue is a water-soluble glue that easily leads to separation between the inner and outer fabric layers after being used for a period of time, such that no resilient shaping effect cannot be achieved; and on the other hand, the multilayer rubber structure is heavy with high thickness, resulting in obvious shaping marks that can be easily identified from the appearance.

BRIEF SUMMARY OF THE INVENTION

In view of the defects in the prior art, the technical problem to be solved by the present invention is to provide a shapewear having a rubber elastic fabric, with excellent mechanical properties, enhanced tensile elastic resilience, durability and undeformability.

To achieve the object above, the present invention employs the following technical solution:

a shapewear having a rubber elastic fabric has a one-piece garment structure or a waist-shaping trousers structure; the shapewear is provided with shaping portions for applying a binding-up force; and more than one shaping portion is a rubber shaping portion, which has a rubber elastic fabric structure.

Preferably, the rubber elastic fabric structure includes a rubber elastic fabric layer resulting from vulcanization molding of a rubber mixing mixture and an elastic base fabric; and air vents are distributed in the rubber elastic fabric layer.

Preferably, the rubber shaping portions include a belly binding portion distributed corresponding to an abdomen of a human body.

Preferably, left and right ends of the belly binding portion extend backwards to a back waist region, respectively; and the back waist region is a shaping portion having an elastic mesh structure.

Preferably, the shaping portions further include a girdling portion and/or back flattening portion having an elastic mesh structure.

Further, the present invention further provides a shapewear having a rubber elastic fabric, wherein the shapewear has a one-piece structure or a waist-shaping trousers structure; the shapewear includes a shell fabric and a lining fabric, which is stitched and connected to an inside of the shell fabric and covered by the shell fabric; and the shapewear is provided with shaping portions for applying a binding-up force; the shaping portions are all disposed on the lining fabric, with more than one shaping portion being a rubber shaping portion, which has a rubber elastic fabric structure.

Further, a middle fabric is stitched and connected between the lining fabric and the shell fabric.

Preferably, the rubber elastic fabric structure comprises a rubber elastic fabric layer resulting from vulcanization molding of a rubber mixing mixture and an elastic base fabric; and the rubber elastic fabric layer has a thickness of 0.3 mm-0.6 mm.

Preferably, air vents are distributed in the rubber elastic fabric layer; and the air vents have an aperture of 0.5 mm-1.5 mm.

Preferably, the rubber shaping portions include a belly binding portion distributed corresponding to an abdomen of a human body; left and right ends of the belly binding portion extend backwards to a back waist region, respectively; and the back waist region is a shaping portion having an elastic mesh structure.

Preferably, the shaping portions further include a girdling portion and/or back flattening portion having an elastic mesh structure.

Compared with the prior art, the present invention has the following beneficial effects:

The shapewear according to the present invention is designed with rubber shaping portions, which are made of a rubber elastic fabric resulting from vulcanization molding of rubber and an elastic base fabric, with the thickness of only 0.3 mm-0.6 mm; the elastic base fabric firmly binds to the rubber to achieve durability and undeformability without binding failure after machine washing; and the rubber elastic fabric has a soft hand feel and can be in direct contact with the skin, and meanwhile, the feel of heaviness can be reduced to achieve an ultralight and ultrathin feel, while excellent tensile strength and tear strength can be maintained and the tensile elastic recovery can be improved. Therefore, the effect of pressurizing, stabilizing, and concentrating the fat can be achieved, shaping marks can be favorably and significantly reduced, and the rubber elastic fabric shows an elastic buffer characteristic to achieve comfort during wearing without a tightening feel. The air vents are provided in the rubber fabric to ensure breathability and comfort.

According to the present invention, the rubber shaping portion is designed as the belly binding portion; from the upper belly to the lower belly, the left and right ends of the belly binding portion having a rubber elastic fabric structure extend to a waist shaping portion having an elastic mesh structure, to collectively shape the waist curves while binding-up and tightening the flab in the whole belly, such that the fat in the belly can be flattened to bind up the belly. According to the present invention, the rubber elastic fabric structure of the belly binding portion is utilized to extend the pressurizing and binding-up force to the back waist to keep the strength and time of the binding-up force on the waist, and the embedment and addition of form-fixing skeletons is not needed, such that curling and displacement hardly occur.

In addition, according to the present invention, the shaping portion is designed on the lining fabric and a connecting shell fabric is stitched to the outer layer; the shell fabric may be made of a common fabric to contribute to the diversification and fashion of decorations on the exterior of the shapewear; moreover, the shapewear has diverse integral styles, and may be Siamese trousers, one-piece garment, one-piece dress, one-piece shirt, or other one-piece garment structures covering both the upper and lower parts of the body, or may have a variety of waist-shaping trousers structures with different waist heights. Meanwhile, the shell fabric does not affect the tensile resilience and shaping function of the lining fabric, and can achieve convenience and neatness by single wear and take-off, as compared with the traditional shapewear that needs an outwear to be worn outside additionally.

DETAILED DESCRIPTION OF THE INVENTION

Embodiment 1

Figure 1:
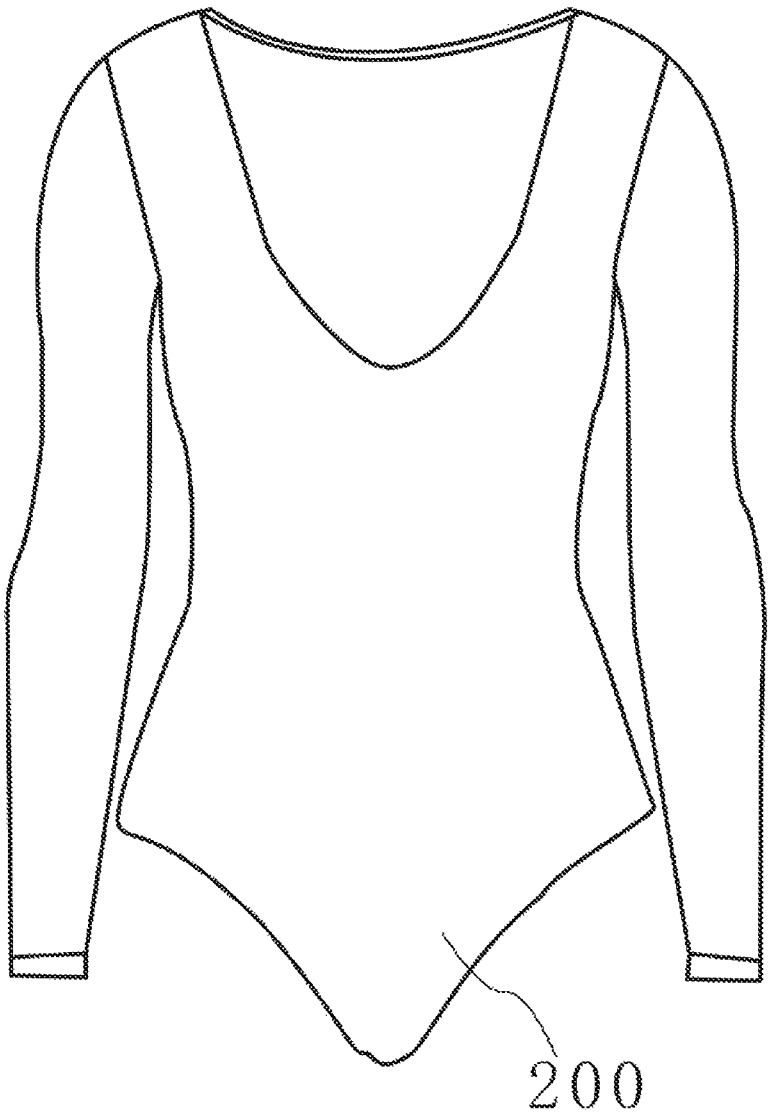
FIG. 1 is a schematic structural diagram of the front side of a shapewear according to Embodiment 1 of the present invention.
Figure 2:
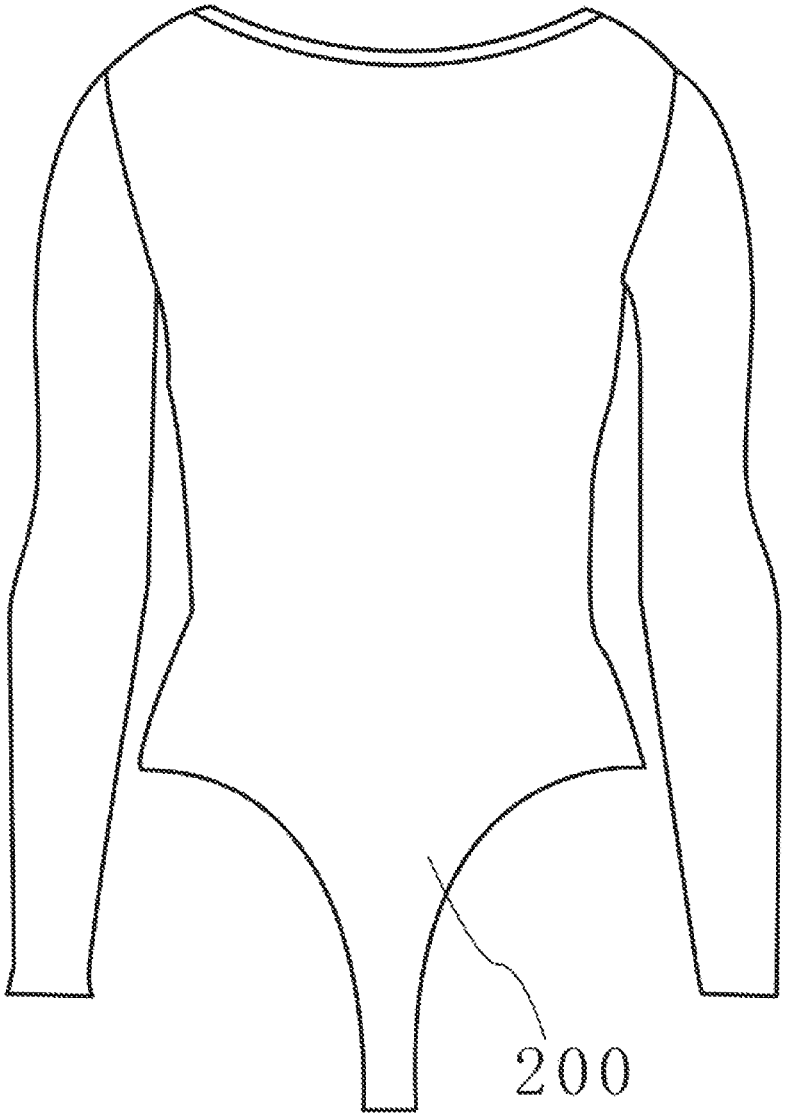
FIG. 2 is a schematic structural diagram of the back side of the shapewear according to Embodiment 1 of the present invention.
Figure 3:
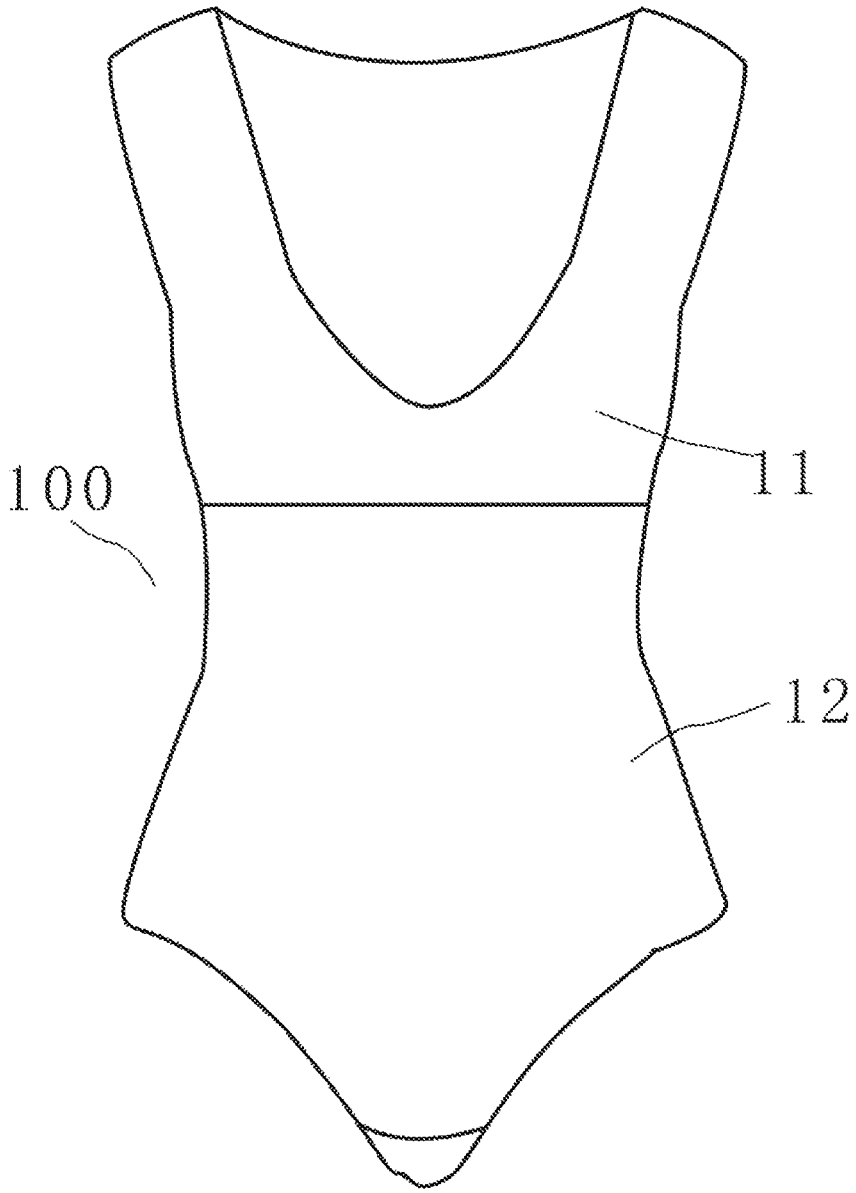
FIG. 3 is a schematic structural diagram of the front side of a lining fabric according to Embodiment 1 of the present invention.
Figure 4:
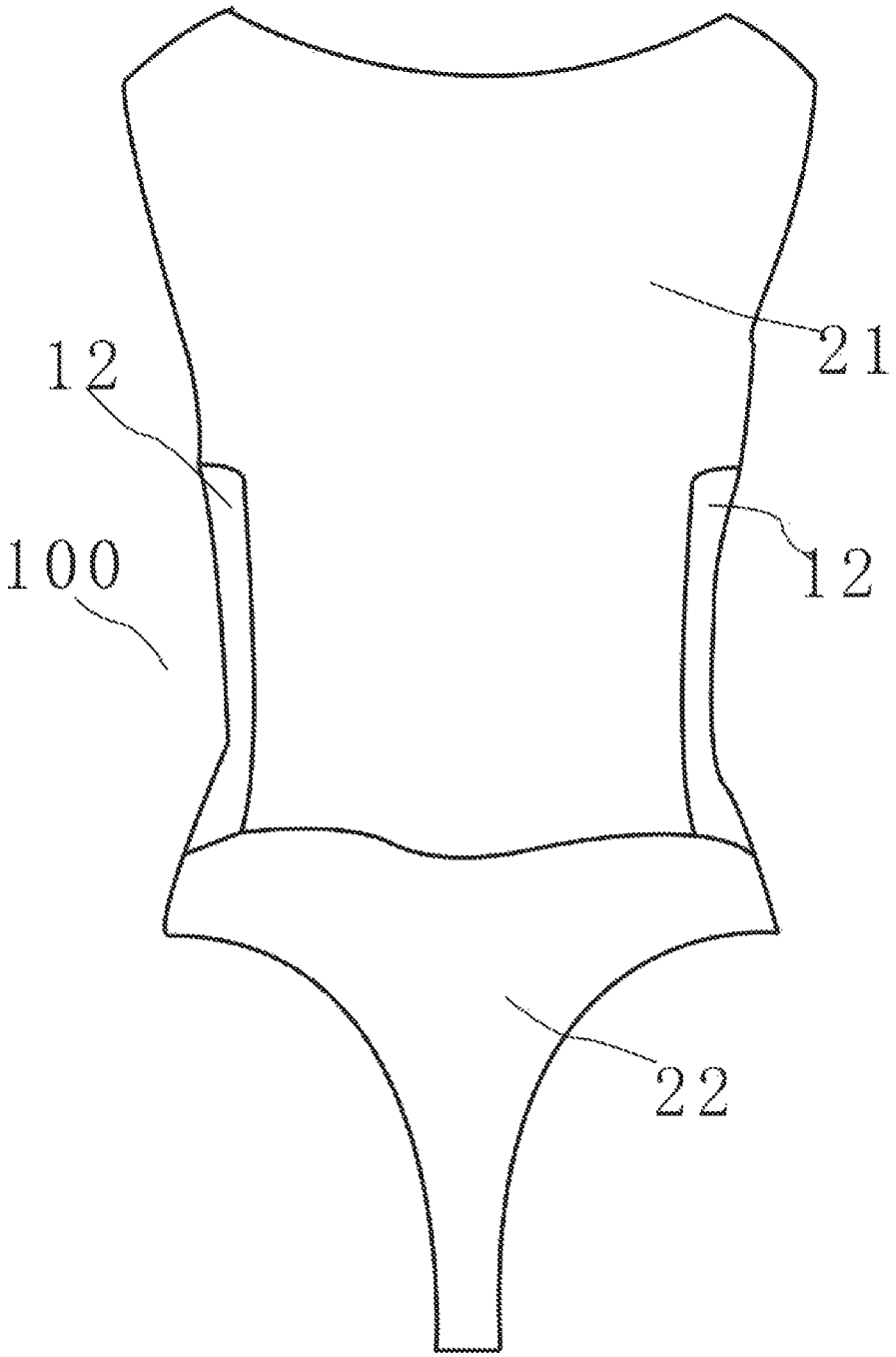
FIG. 4 is a schematic structural diagram of the back side of the lining fabric according to Embodiment 1 of the present invention.

As shown in FIGS. 1-4, this embodiment provides a shapewear, including a shell fabric 200 and a lining fabric 100. The lining fabric 100 is stitched and connected to the inside of the shell fabric 200 to collectively form a one-piece structure, and the lining fabric 100 is covered by the shell fabric 200.

The lining fabric 100 includes a first front lining 11, a second front lining 12, a first back lining 21, and a second back lining 22. The first front lining 11 is distributed corresponding to a region at and above the chest of a human body; the second front lining 12 is distributed corresponding to upper and lower belly regions (the upper belly located above the belly button, and the lower belly located below the belly button) below the chest of the human body; and the first front lining 11 is stitched and connected to an upward side of the second front lining 12 by means of elastic bands.

The first back lining 21 is distributed corresponding to back and waist regions of the human body; the second back lining 22 is distributed corresponding to a hip region of the human body; and the first back lining 21 is stitched and connected to the upward side of the second back lining 22 by means of four needle six lines.

An upper end of the first front lining 11 and an upper end of the first back lining 21 are stitched and connected to form shoulder seams; and left and right ends of the first front lining 11 and corresponding ends of the first back lining 21 are stitched and connected to form muffs of the lining fabric. The first front lining 11 and the first back lining 21 form a deep V-neck structure at a neckline of the lining fabric. Preferably, the first front lining 11 is made of a skin-fit fabric such as a cotton or modal fabric; and the first back lining 21 has an elastic mesh structure to form, in a wear state, a waist binding portion and a back flattening portion, which are connected together and can apply a binding-up force to the waist and back.

The second front lining 12 has a rubber elastic fabric structure to serve as a rubber shaping portion, and in this embodiment, the second front lining 12 forms the belly binding portion of the shapewear.

In this embodiment, the left and right ends of the belly binding portion extend backwards to the back waist region by 2 cm-4 cm, respectively. That is, the suture between the second front lining 12 and the first back lining 21 is moved backwards by 2 cm-4 cm, thereby matching the first back lining 21 to shape the waist curves. Moreover, the rubber elastic fabric structure of the belly binding portion is utilized to extend the pressurizing and binding-up force to the back waist to keep the strength and time of the binding-up force on the waist.

The lower part of the second front lining 12 corresponding to the lower belly region has a front briefs piece structure; the second back lining 22 has a T-back back piece structure; and the left and right sides of the lower part of the second front lining 12 are stitched and connected to the corresponding sides of the second back lining 22 respectively to form leg openings of the lining fabric. Preferably, the second back lining 22 is made of a skin-fit fabric such as a cotton or modal fabric.

The shell fabric 200 includes a front garment piece, a back garment piece, and two sleeves; the front garment piece and the back garment piece are stitched and connected to the lining fabric at the muffs, neck line, and leg openings; and the two sleeves are stitched and connected to the muffs of the shell fabric between the front garment piece and the back garment piece. Further, to facilitate defecation, the second front lining 12 and the second back lining 22 are each provided at the bottom with a crotch opening, at which a bottom crotch cloth is provided detachably by a conventional manner such as snap fasteners.

Embodiment 2

Figure 5:
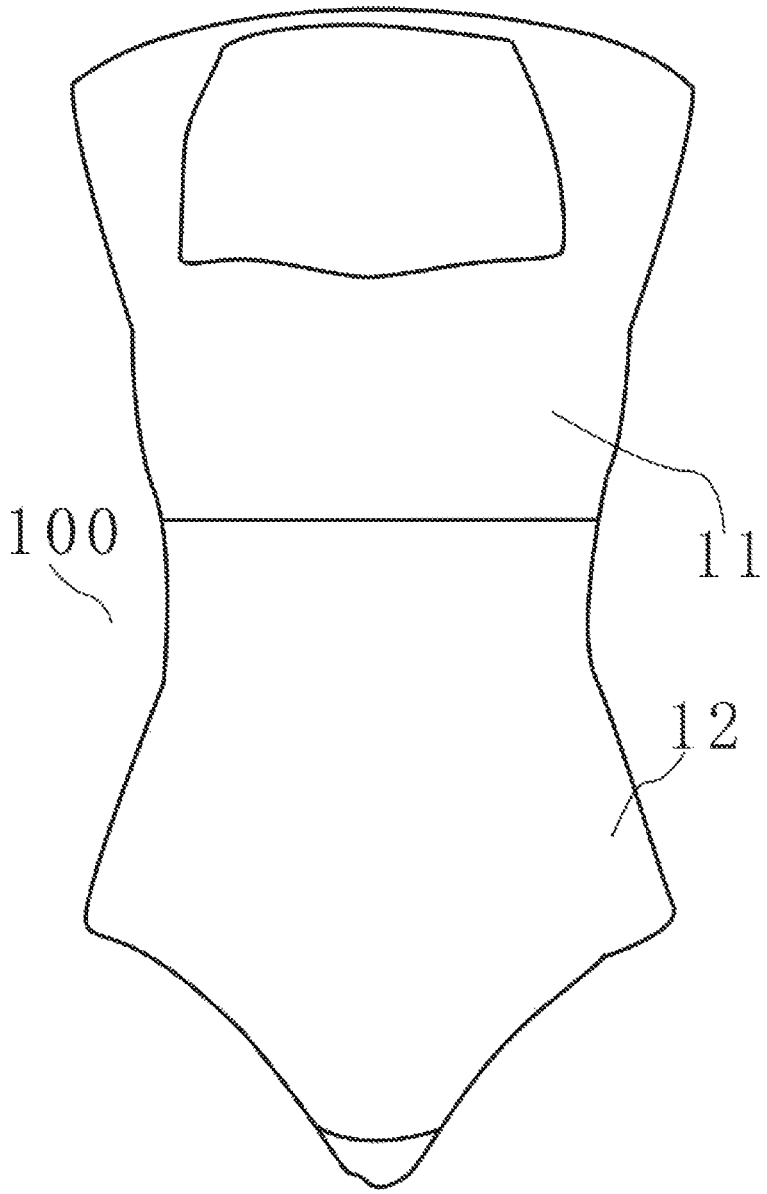
FIG. 5 is a schematic structural diagram of the front side of a lining fabric according to Embodiment 2 of the present invention.
Figure 6:
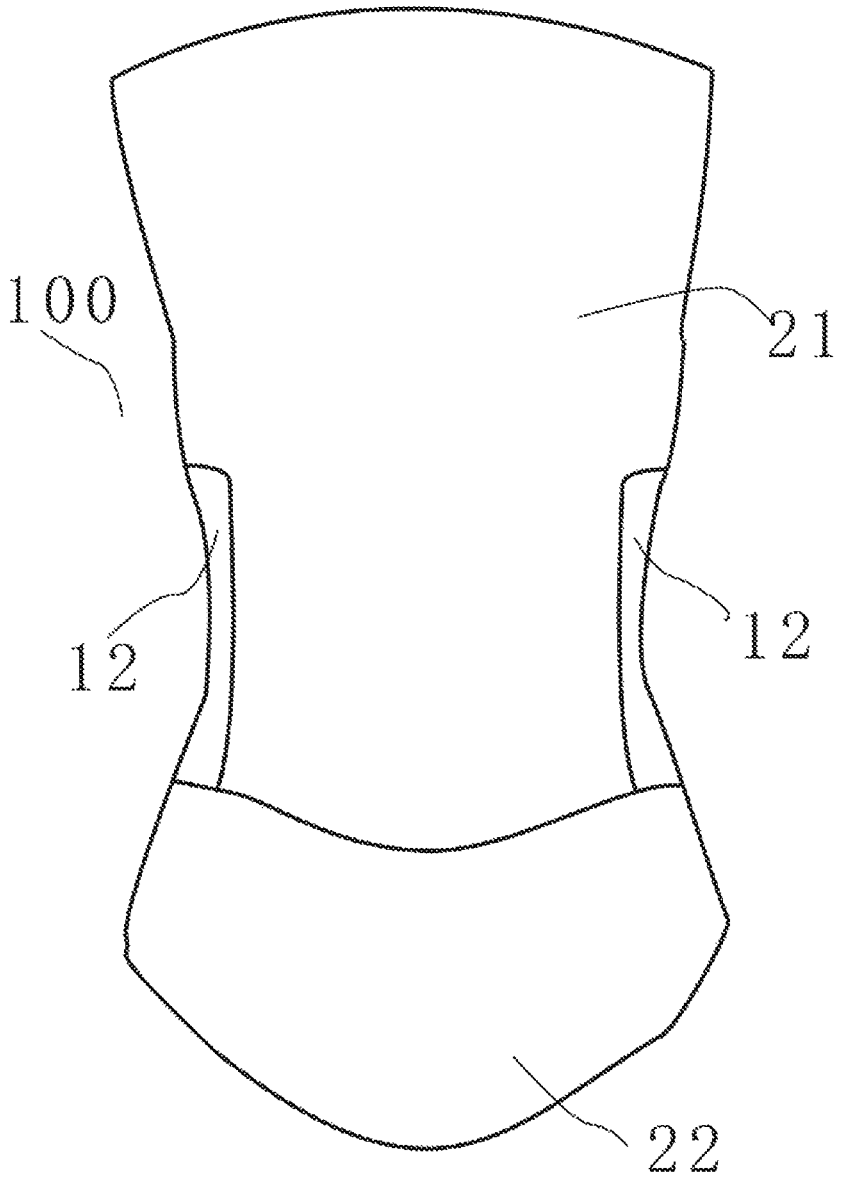
FIG. 6 is a schematic structural diagram of the back side of the lining fabric according to Embodiment 2 of the present invention.

This embodiment differs from Embodiment 1 described above only in that: 1, the first front lining 11 and the first back lining 21 form a square collarless neck structure at the neckline of the lining fabric; and 2, the second back lining 22 has a full hip wrapping structure, as shown in FIGS. 5-6.

Embodiment 3

Figure 7:
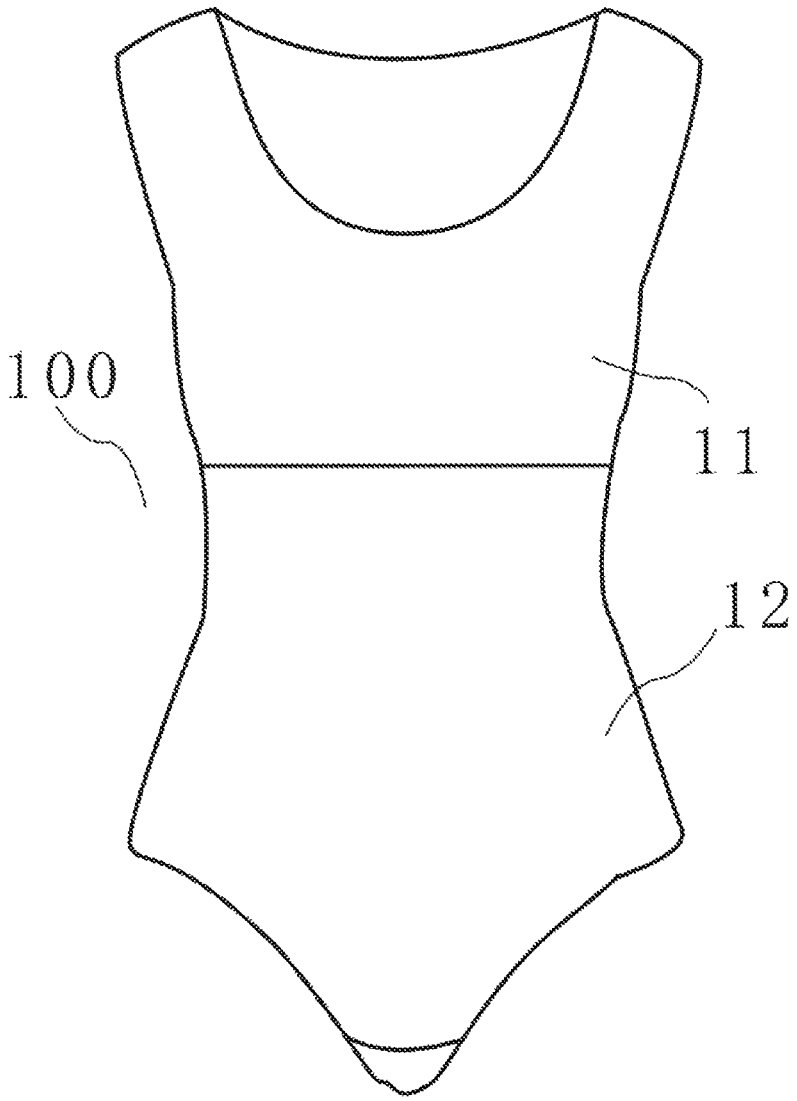
FIG. 7 is a schematic structural diagram of the front side of a lining fabric according to Embodiment 3 of the present invention.

This embodiment differs from Embodiment 1 described above only in that: 1, the first front lining 11 and the first back lining 21 form a round collarless neck structure at the neckline of the lining fabric, as shown in FIG. 7.

Embodiment 4

Figure 8:
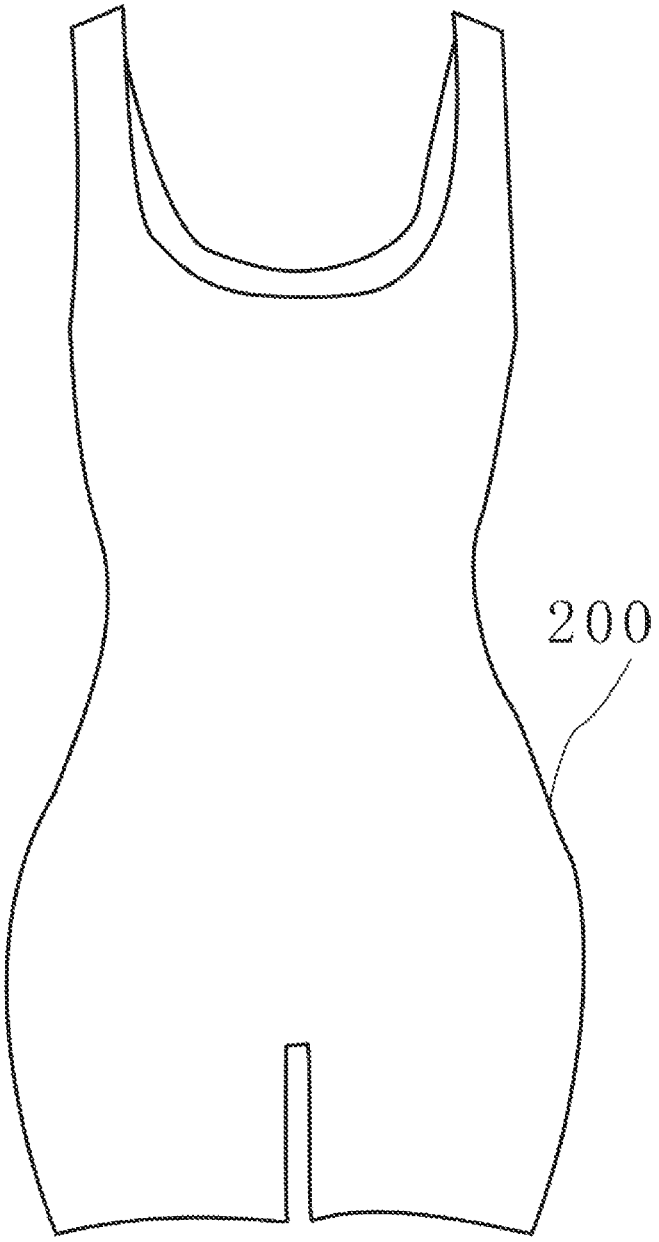
FIG. 8 is a schematic structural diagram of the front side of a shapewear according to Embodiment 4 of the present invention.
Figure 9:
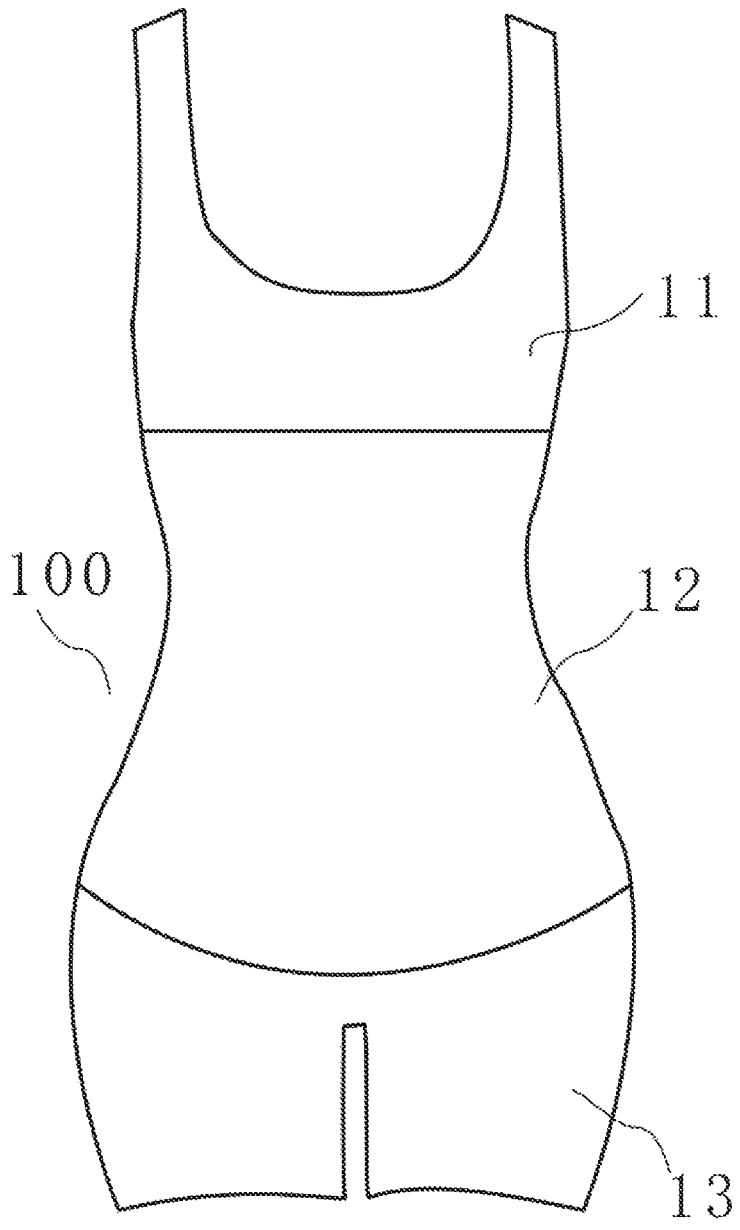
FIG. 9 is a schematic structural diagram of the front side of a lining fabric according to Embodiment 4 of the present invention.
Figure 10:
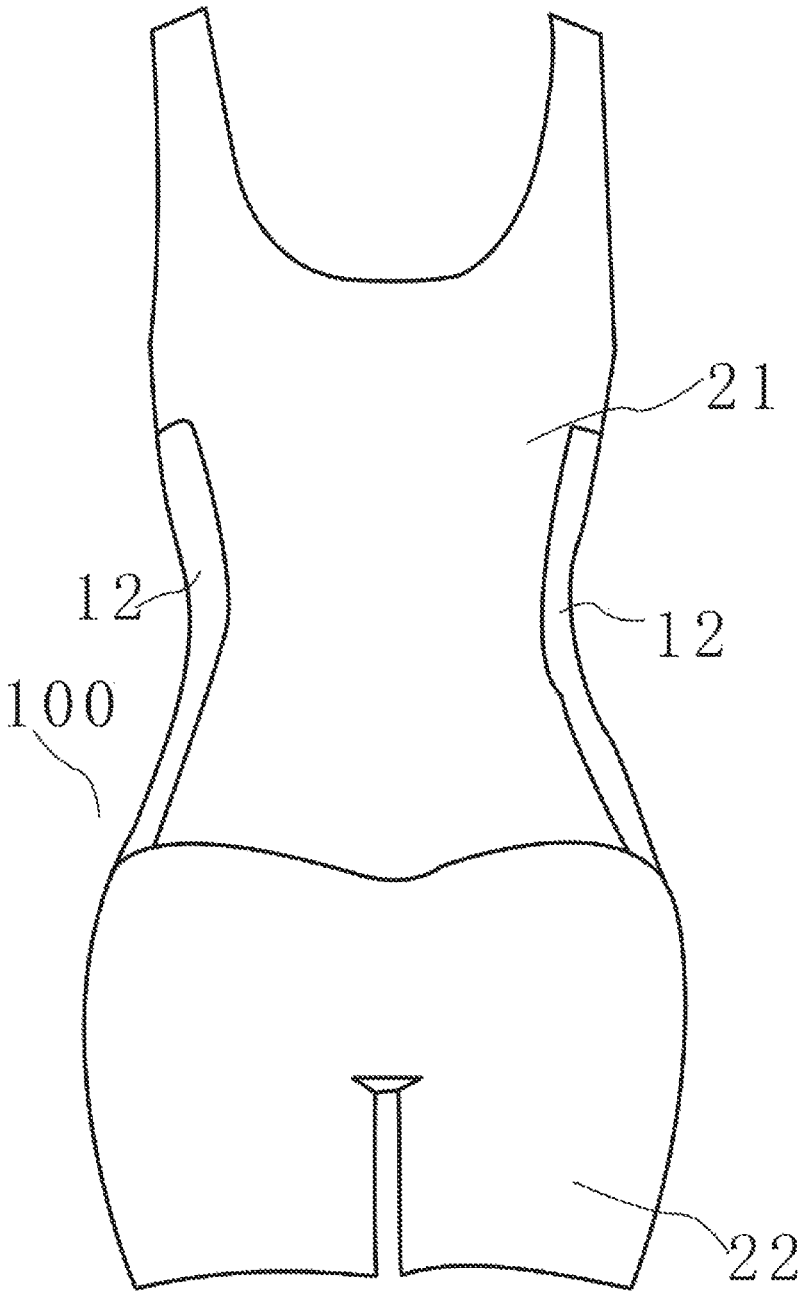
FIG. 10 is a schematic structural diagram of the back side of the lining fabric according to Embodiment 4 of the present invention.

As shown in FIGS. 8-10, this embodiment provides a shapewear, including a shell fabric 200 and a lining fabric 100. The lining fabric 100 is stitched and connected to the inside of the shell fabric 200 to collectively form a Siamese trousers structure, and the lining fabric 100 is covered by the shell fabric 200.

The lining fabric 100 includes a first front lining 11, a second front lining 12, a third front lining 13, a first back lining 21, and a second back lining 22. The first front lining 11 is distributed corresponding to a region at and above the chest of a human body; the second front lining 12 is distributed corresponding to upper and lower belly regions (the upper belly located above the belly button, and the lower belly located below the belly button) below the chest of the human body; the third front lining 13 is distributed corresponding to thigh regions of the human body; the first front lining 11 is stitched and connected to an upward side of the second front lining 12 by means of elastic bands; and the third front lining 13 is stitched and connected to a lower side of the second front lining 12 by means of zigzag sewing. The first back lining 21 is distributed corresponding to a region at and above the waist of the human body; the second back lining 22 is distributed corresponding to hip and thigh regions of the human body; and the first back lining 21 is stitched and connected to the upward side of the second back lining 22 by means of four needle six lines.

An upper end of the first front lining 11 and an upper end of the first back lining 21 are stitched and connected to form two suspenders; and left and right ends of the first front lining 11 and corresponding ends of the first back lining 21 are stitched and connected to form muffs of the lining fabric. The first front lining 11 and the first back lining 21 form a suspender neck structure at a neckline of the lining fabric. Preferably, the first front lining 11 is made of a skin-fit fabric such as a cotton or modal fabric; and the first back lining 21 has an elastic mesh structure to form, in a wear state, a waist binding portion and a back flattening portion, which are connected together and can apply a binding-up force to the waist and back.

The second front lining 12 has a rubber elastic fabric structure to serve as a rubber shaping portion, and in this embodiment, the second front lining 12 forms the belly binding portion of the shapewear.

In this embodiment, the left and right ends of the belly binding portion extend backwards to the back waist region by 2 cm-4 cm, respectively. That is, the suture between the second front lining 12 and the first back lining 21 is moved backwards by 2 cm-4 cm, thereby matching the first back lining 21 to shape the waist curves. Moreover, the rubber elastic fabric structure of the belly binding portion is utilized to extend the pressurizing and binding-up force to the back waist to keep the strength and time of the binding-up force on the waist.

The lower part of the second front lining 12 corresponding to the lower belly region has an arc structure; the second back lining 22 has a boxer-brief back piece structure; and the left and right sides of the third front lining 13 are stitched and connected to the corresponding sides of the second back lining 22 respectively to form trousers legs of the lining fabric. Preferably, the third front lining 13 and the second back lining 22 are both made of a skin-fit fabric such as a cotton or modal fabric.

The shell fabric 200 includes a front garment piece and a back garment piece; and the front garment piece and the back garment piece are stitched and connected to the lining fabric 200 at the neck line, suspenders, and leg openings, respectively. Further, to facilitate defecation, the third front lining 13 and the second back lining 22 are each provided at the bottom with a crotch opening, at which a bottom crotch cloth is provided detachably by a conventional manner such as snap fasteners.

Embodiment 5

Figure 11:
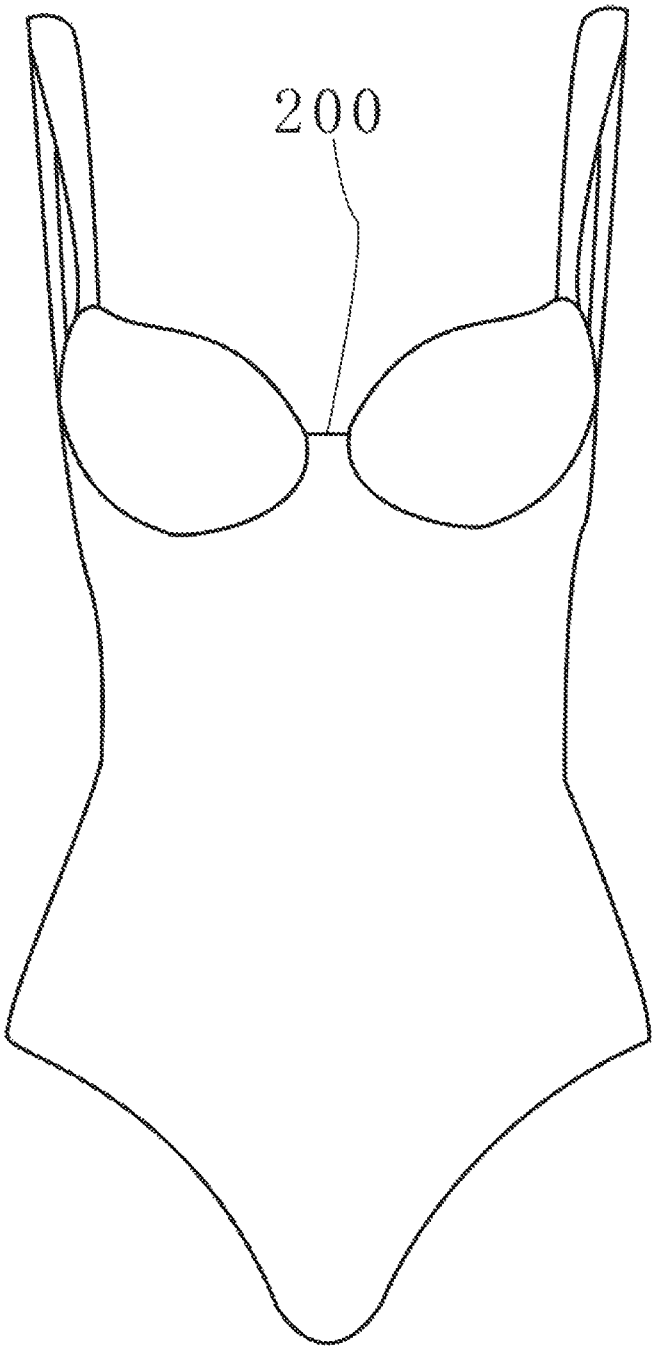
FIG. 11 is a schematic structural diagram of the front side of a shapewear according to Embodiment 5 of the present invention.
Figure 12:
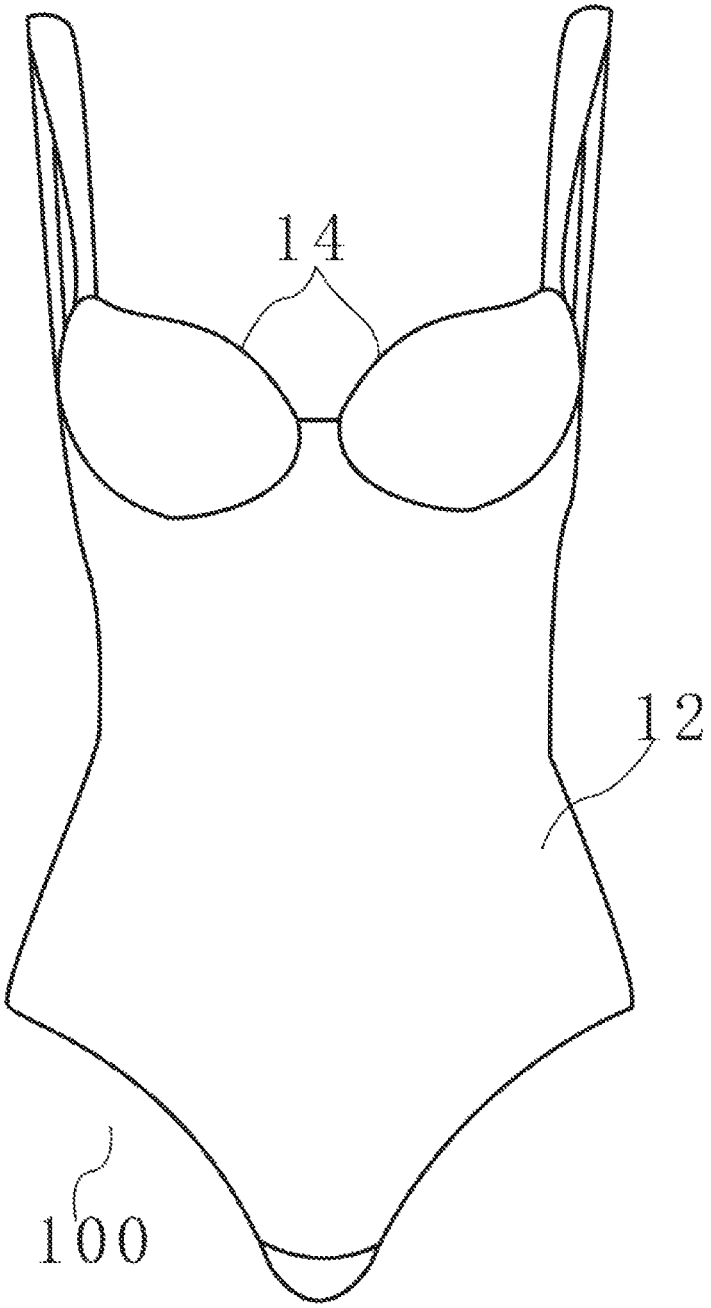
FIG. 12 is a schematic structural diagram of the front side of a lining fabric according to Embodiment 5 of the present invention.
Figure 13:
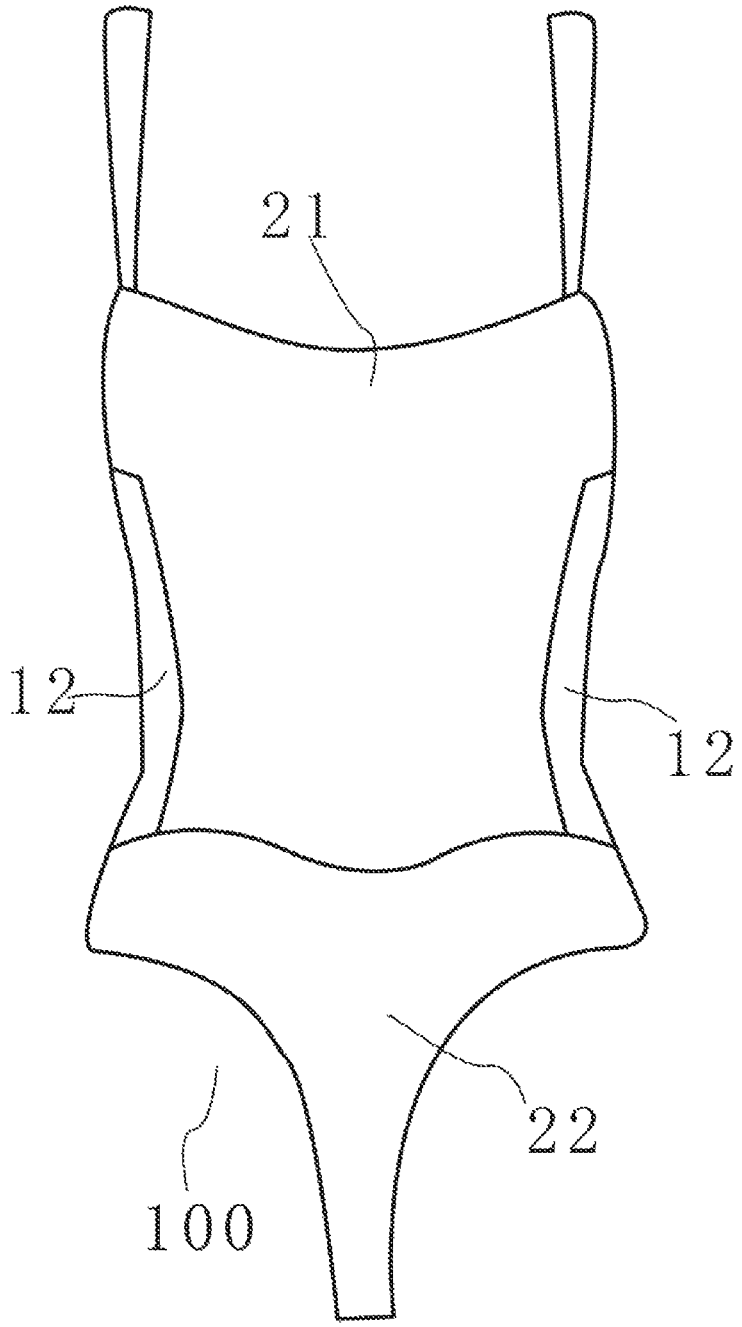
FIG. 13 is a schematic structural diagram of the back side of the lining fabric according to Embodiment 5 of the present invention.

As shown in FIGS. 11-13, this embodiment provides a shapewear, including a shell fabric 200 and a lining fabric 100. The lining fabric 100 is stitched and connected to the inside of the shell fabric 200 to collectively form a one-piece garment structure, and the lining fabric 100 is covered by the shell fabric 200.

The lining fabric 100 includes two lining-fabric mould cups 14, a second front lining 12, a first back lining 21, a second back lining 22, and two shoulder straps. The lining-fabric mould cups 14 are distributed corresponding the chest region of the human body and are preferably ¾ mould cups; the second front lining 12 is distributed corresponding to upper and lower belly regions (the upper belly located above the belly button, and the lower belly located below the belly button) below the chest of the human body; and the second front lining 12 is stitched and connected to the lower sides of the lining-fabric mould cups 14 by means of elastic bands. The first back lining 21 is distributed corresponding to back and waist regions of the human body; the second back lining 22 is distributed corresponding to a hip region of the human body; the first back lining 21 is stitched and connected to the upward side of the second back lining 22 by means of four needle six lines; and the two shoulder straps are stitched and connected to the upper ends of the lining-fabric mould cups 14 and the upper end of the first back lining 21, respectively. Preferably, the lining-fabric mould cups 14 and the shoulder straps are made of a skin-fit fabric such as a cotton or modal fabric; and the first back lining 21 has an elastic mesh structure to form, in a wear state, a waist binding portion and a back flattening portion, which are connected together and can apply a binding-up force to the waist and back.

The second front lining 12 has a rubber elastic fabric structure to serve as a rubber shaping portion, and in this embodiment, the second front lining forms the belly binding portion of the shapewear.

In this embodiment, the left and right ends of the belly binding portion extend backwards to the back waist region by 2 cm-4 cm, respectively. That is, the suture between the second front lining 12 and the first back lining 21 is moved backwards by 2 cm-4 cm, thereby matching the first back lining 21 to shape the waist curves. Moreover, the rubber elastic fabric structure of the belly binding portion is utilized to extend the pressurizing and binding-up force to the back waist to keep the strength and time of the binding-up force on the waist.

The lower part of the second front lining 12 corresponding to the lower belly region has a front briefs piece structure; the second back lining 22 has a T-back back piece structure; and the left and right sides of the lower part of the second front lining 12 are stitched and connected to the corresponding sides of the second back lining 22 respectively to form leg openings of the lining fabric. Preferably, the second back lining 22 is made of a skin-fit fabric such as a cotton or modal fabric.

The shell fabric 200 includes a front garment piece and a back garment piece; and the shell fabric 200 is stitched and connected to the lining fabric 100 at the neck line, mould cups, neckline, and leg openings, respectively. Further, to facilitate defecation, the second front lining 12 and the second back lining 22 are each provided at the bottom with a crotch opening, at which a bottom crotch cloth is provided detachably by a conventional manner such as snap fasteners.

Embodiment 6

Figure 14:
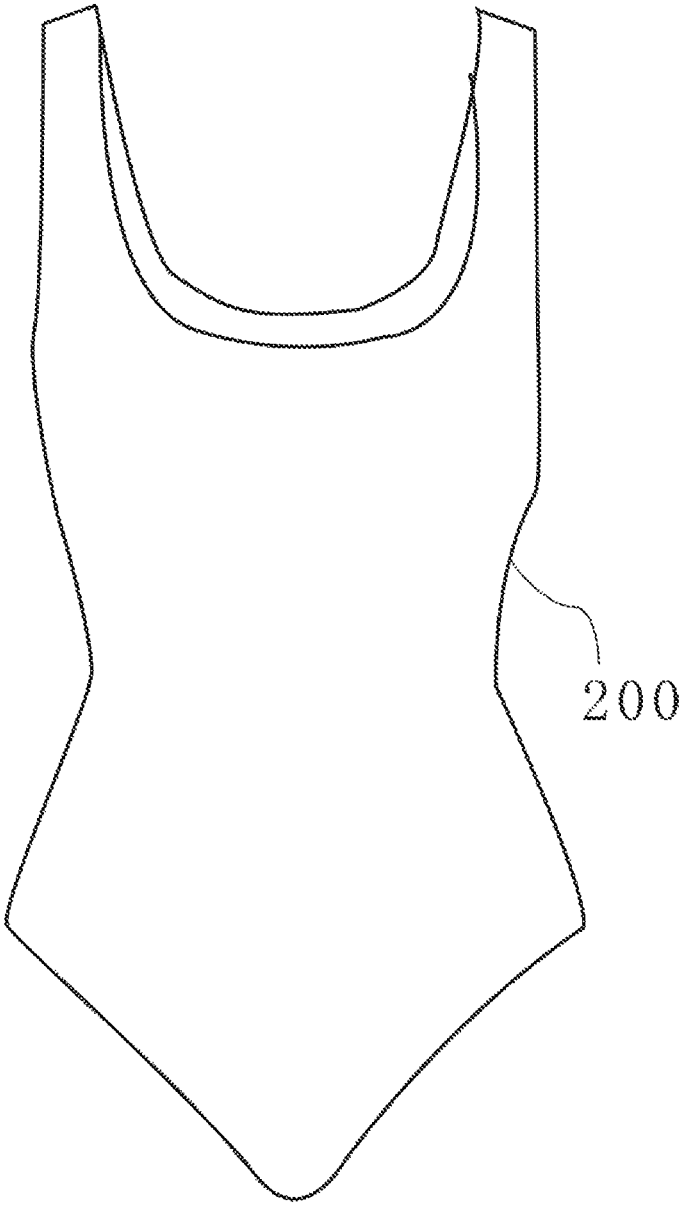
FIG. 14 is a schematic structural diagram of the front side of a shapewear according to Embodiment 6 of the present invention.
Figure 15:
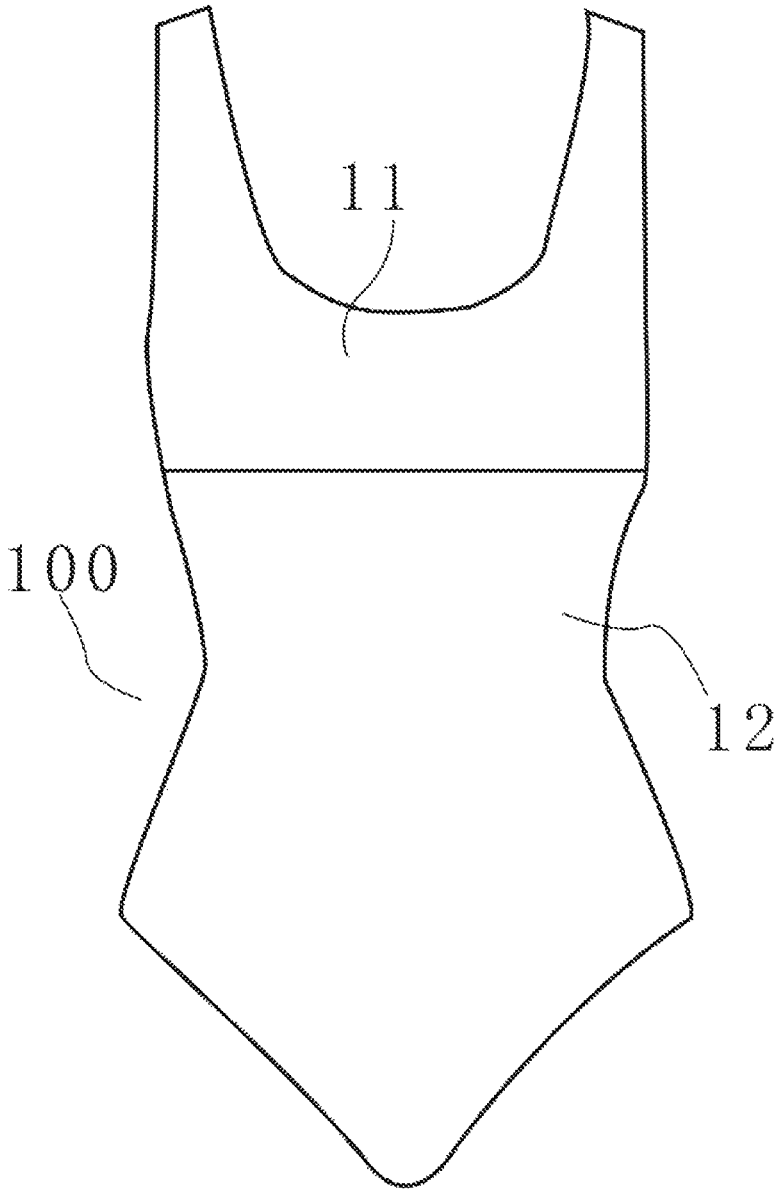
FIG. 15 is a schematic structural diagram of the front side of a lining fabric according to Embodiment 6 of the present invention.
Figure 16:
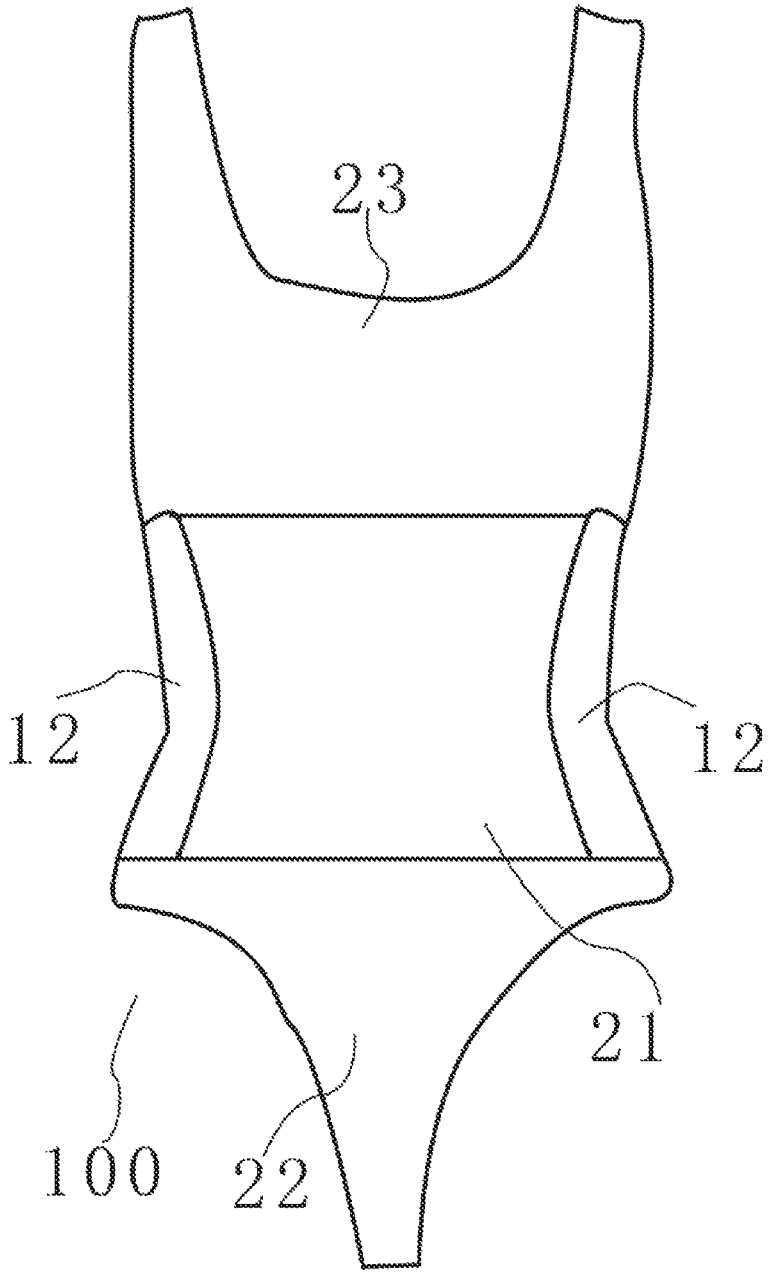
FIG. 16 is a schematic structural diagram of the back side of the lining fabric according to Embodiment 6 of the present invention.

As shown in FIGS. 14-16, this embodiment provides a shapewear, including a shell fabric 200, a lining fabric 100, and an intermediate fabric. The lining fabric 100 and the intermediate fabric are both stitched and connected to the inside of the shell fabric 200 to collectively form a one-piece garment structure; and the lining fabric 100 is covered by the shell fabric 200, and the intermediate fabric is between the shell fabric 200 and the lining fabric 100. The shell fabric 200 has a mesh structure, and the intermediate fabric may be used to cover the lining fabric 100 to make the lining fabric invisible from the appearance.

The lining fabric 100 includes a first front lining 11, a second front lining 12, a first back lining 21, a second back lining 22, and a third back lining 23. The first front lining 11 is distributed corresponding to a region at and above the chest of a human body; the second front lining 12 is distributed corresponding to upper and lower belly regions (the upper belly located above the belly button, and the lower belly located below the belly button) below the chest of the human body; and the first front lining 11 is stitched and connected to an upward side of the second front lining 12 by means of elastic bands. The first back lining 21 is distributed corresponding to a waist region of the human body; the third back lining 23 is distributed corresponding to a back region of the human body; the second back lining 22 is distributed corresponding to a hip region of the human body; and the first back lining 21 is stitched and connected to the upward side of the second back lining 22 and the lower side of the third back lining 23 by means of four needle six lines. An upper end of the first front lining 11 and an upper end of the first back lining 23 are stitched and connected to form two suspenders; and left and right ends of the first front lining 11 and corresponding ends of the third back lining 23 are stitched and connected to form muffs of the lining fabric. The first front lining 11 and the third back lining 23 form a suspender neck structure at a neckline of the lining fabric. Preferably, the first front lining 11 and the third back lining 23 are made of a skin-fit fabric such as a cotton or modal fabric.

The first back lining 21 has an elastic mesh structure to form, in a wear state, a waist binding portion capable of applying a binding-up force to the waist; the second front lining 12 has a rubber elastic fabric structure to serve as a rubber shaping portion; and the second front lining 12 forms the belly binding portion of the shapewear capable of applying a binding-up force to the belly. In this embodiment, the left and right ends of the belly binding portion extend backwards to the back waist region by 2 cm-4 cm, respectively. That is, the suture between the second front lining 12 and the first back lining 21 is moved backwards by 2 cm-4 cm, thereby matching the first back lining 21 to shape the waist curves. Moreover, the rubber elastic fabric structure of the belly binding portion is utilized to extend the pressurizing and binding-up force to the back waist to keep the strength and time of the binding-up force on the waist.

The lower part of the second front lining 12 corresponding to the lower belly region has a front briefs piece structure; the second back lining 22 has a T-back back piece structure; and the left and right sides of the lower part of the second front lining 12 are stitched and connected to the corresponding sides of the second back lining 22 respectively to form leg openings of the lining fabric. Preferably, the second back lining 22 is made of a skin-fit fabric such as a cotton or modal fabric.

The shell fabric 200 and the intermediate fabric each include a front garment piece and a back garment piece; and the shell fabric 200 and the intermediate fabric are stitched and connected to the lining fabric 100 at the muffs, neck line, and leg openings, respectively. Further, to facilitate defecation, the second front lining 12 and the second back lining 22 are each provided at the bottom with a crotch opening, at which a bottom crotch cloth is provided detachably by a conventional manner such as snap fasteners.

Embodiment 7

Figure 17:
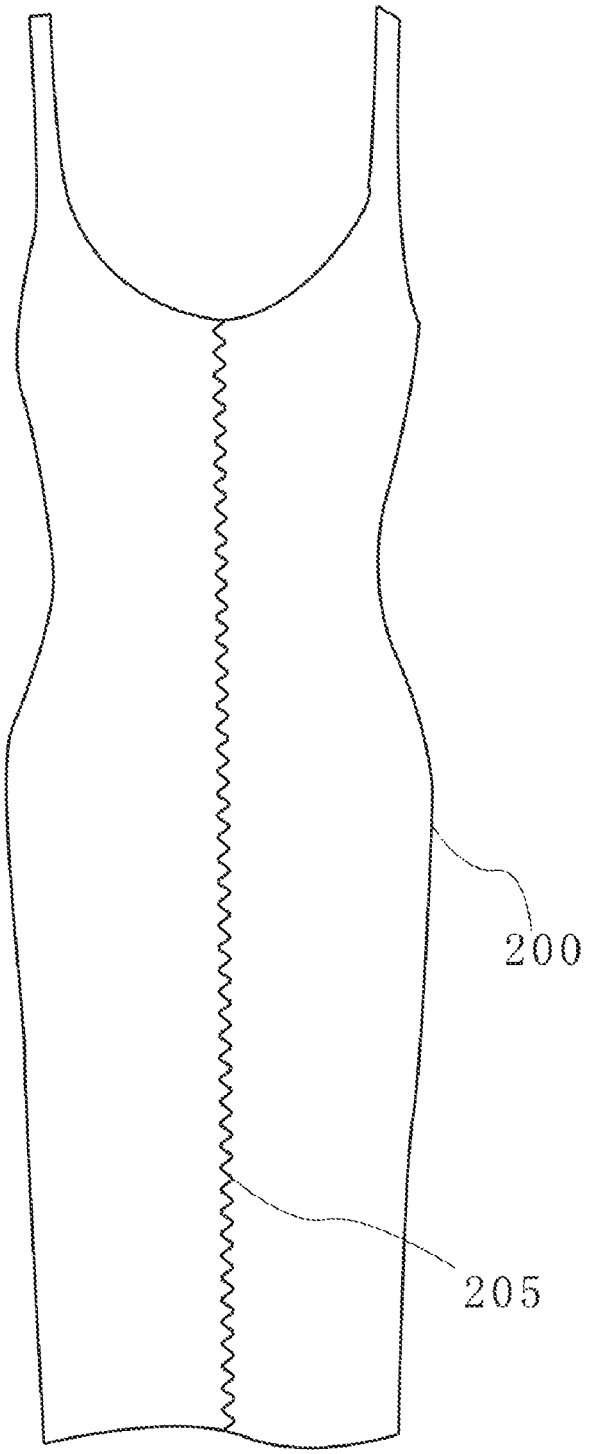
FIG. 17 is a schematic structural diagram of the front side of a shapewear according to Embodiment 7 of the present invention.
Figure 18:
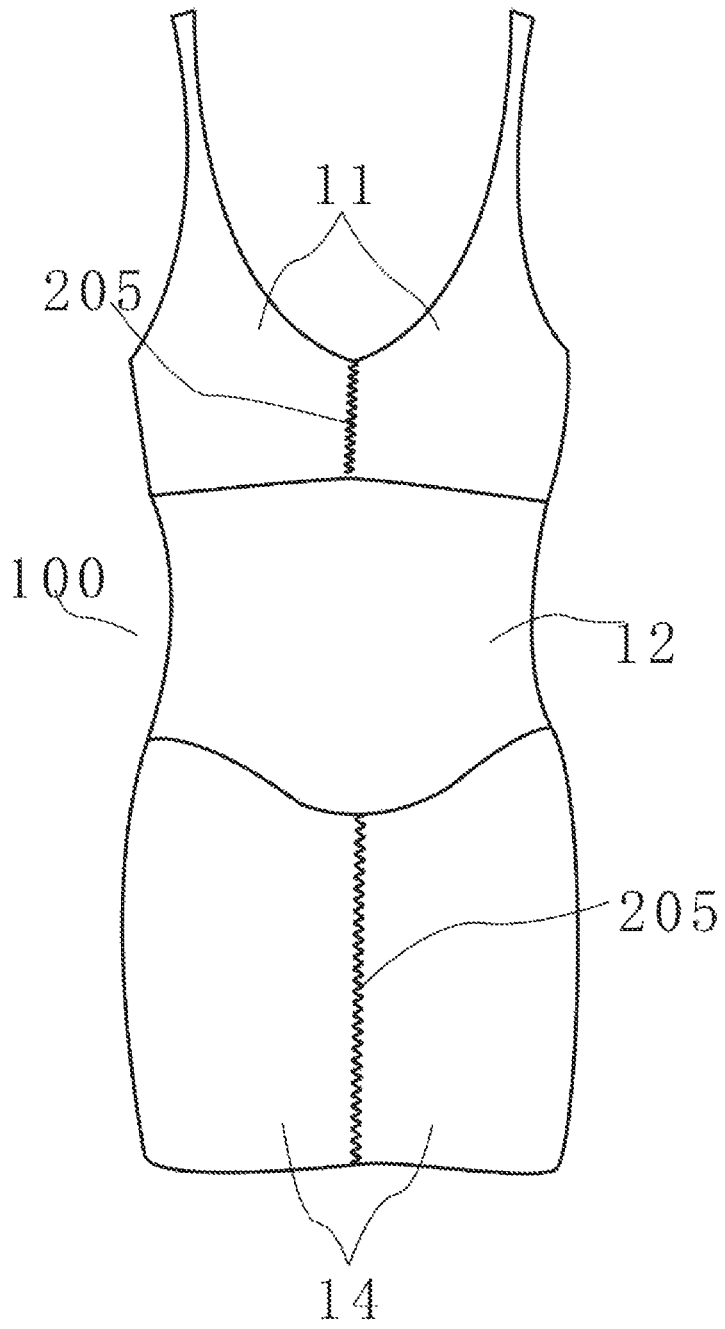
FIG. 18 is a schematic structural diagram of the front side of a lining fabric according to Embodiment 7 of the present invention.
Figure 19:
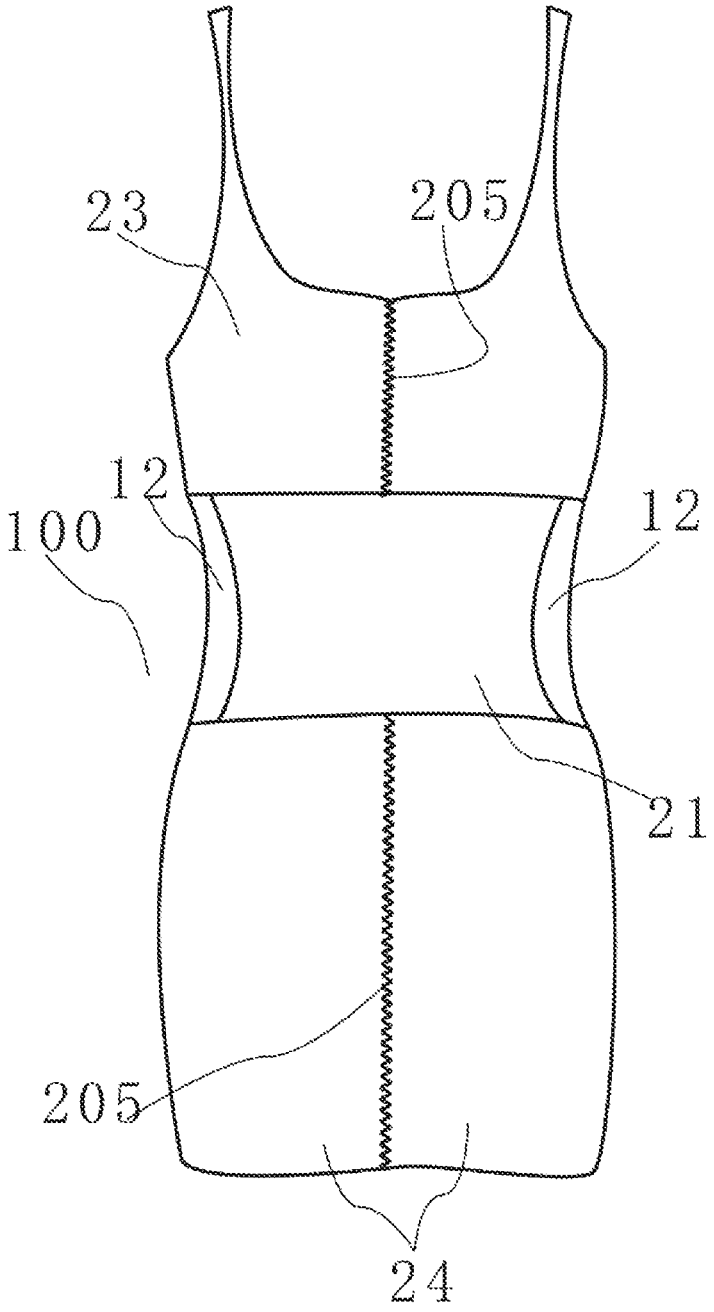
FIG. 19 is a schematic structural diagram of the back side of the lining fabric according to Embodiment 7 of the present invention.

As shown in FIGS. 17-19, this embodiment provides a shapewear, including a shell fabric 200, a lining fabric 100, and an intermediate fabric. The lining fabric 100 and the intermediate fabric are both stitched and connected to the inside of the shell fabric 200 to collectively form a one-piece dress structure; and the lining fabric 100 is covered by the shell fabric 200, and the intermediate fabric is between the shell fabric 200 and the lining fabric 100. The shell fabric 200 has a mesh structure, and the intermediate fabric may be used to cover the lining fabric 100 to make the lining fabric invisible from the appearance.

The lining fabric 100 includes a first front lining 11, a second front lining 12, a third front lining 14, a first back lining 21, a second back lining 23, and a back lining 24. The first front lining 11 is distributed corresponding to a region at and above the chest of a human body; the second front lining 12 is distributed corresponding to upper and lower belly regions (the upper belly located above the belly button, and the lower belly located below the belly button) below the chest of the human body; the front lining 14 is distributed corresponding to thigh regions of the human body; the first front lining 11 is stitched and connected to an upward side of the second front lining 12 by means of elastic bands; and the front lining 14 is stitched and connected to a lower side of the second front lining 12 by means of zigzag sewing. The first back lining 21 is distributed corresponding to a waist region of the human body; the second back lining 23 is distributed corresponding to a back region of the human body; the back lining 24 is distributed corresponding to hip and thigh regions of the human body; and the first back lining 21 is stitched and connected to the upward side of the back lining 24 and the lower side of the second back lining 23 by means of four needle six lines.

An upper end of the first front lining 11 and an upper end of the first back lining 23 are stitched and connected to form two suspenders; and left and right ends of the first front lining 11 and corresponding ends of the second back lining 23 are stitched and connected to form muffs of the lining fabric. The first front lining 11 and the second back lining 23 form a suspender neck structure at a neckline of the lining fabric. Preferably, the first front lining 11 and the second back lining 23 are made of a skin-fit fabric such as a cotton or modal fabric.

The first back lining 21 has an elastic mesh structure to form, in a wear state, a waist binding portion capable of applying a binding-up force to the waist; the second front lining 12 has a rubber elastic fabric structure to serve as a rubber shaping portion; and the second front lining 12 forms the belly binding portion of the shapewear capable of applying a binding-up force to the belly. In this embodiment, the left and right ends of the belly binding portion extend backwards to the back waist region by 2 cm-4 cm, respectively. That is, the suture between the second front lining 12 and the first back lining 21 is moved backwards by 2 cm-4 cm, thereby matching the first back lining 21 to shape the waist curves. Moreover, the rubber elastic fabric structure of the belly binding portion is utilized to extend the pressurizing and binding-up force to the back waist to keep the strength and time of the binding-up force on the waist.

The lower part of the second front lining 12 corresponding to the lower belly region has an arc structure; the front lining 14 has a front dress piece structure; the back lining 24 has a back dress piece structure; and the left and right sides of the front lining 14 are stitched and connected to the corresponding sides of the back lining 24 respectively. Preferably, the front lining 14 and the back lining 24 are both made of a skin-fit fabric such as a cotton or modal fabric.

The shell fabric 200 and the intermediate fabric each include a front garment piece and a back garment piece; the first front lining 11, the front lining 14, the first back lining 21, the second back lining 23, the back lining 24 as well as the front and back garment pieces of the shell fabric 200 are each torn in the middle at which longitudinal rubber bands 201 are sewn; meanwhile, side seams between the front and back garment pieces of the shell fabric 200 are also sewn with longitudinal rubber bands; and the shell fabric 200 and the intermediate fabric are stitched and connected to the lining fabric 100 at the side seams, middle torn seams, and necklines.

Embodiment 8

Figure 20:
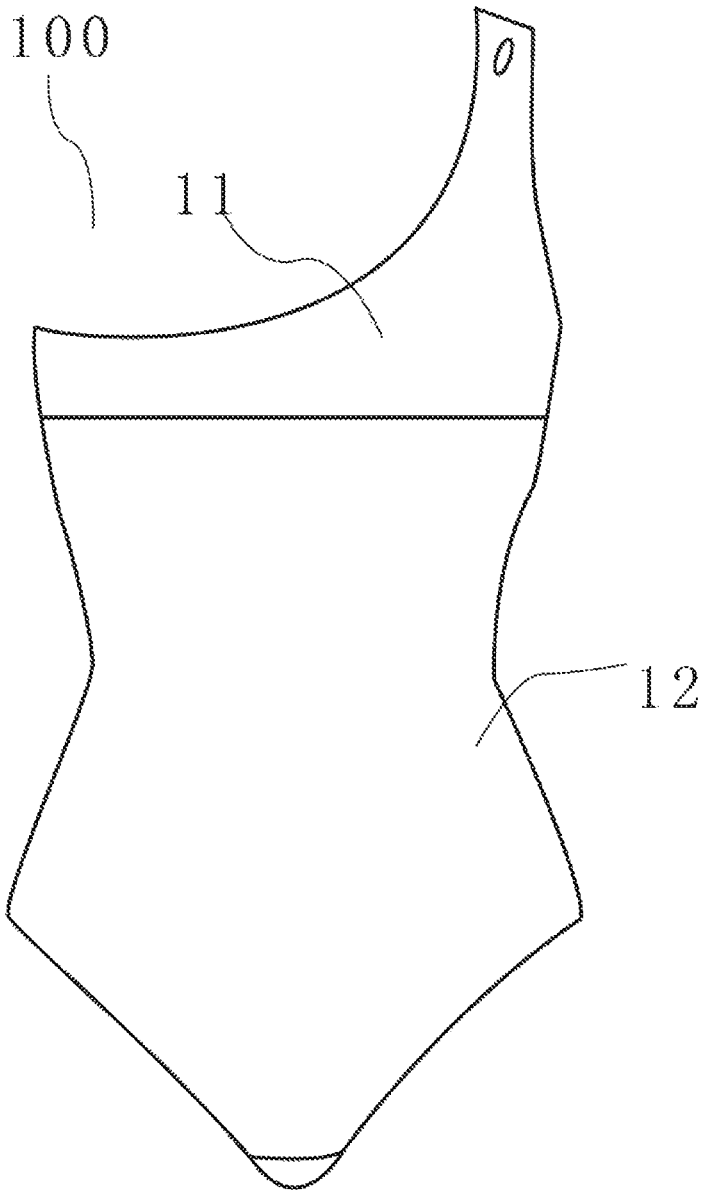
FIG. 20 is a schematic structural diagram of the front side of a lining fabric according to Embodiment 8 of the present invention.
Figure 21:
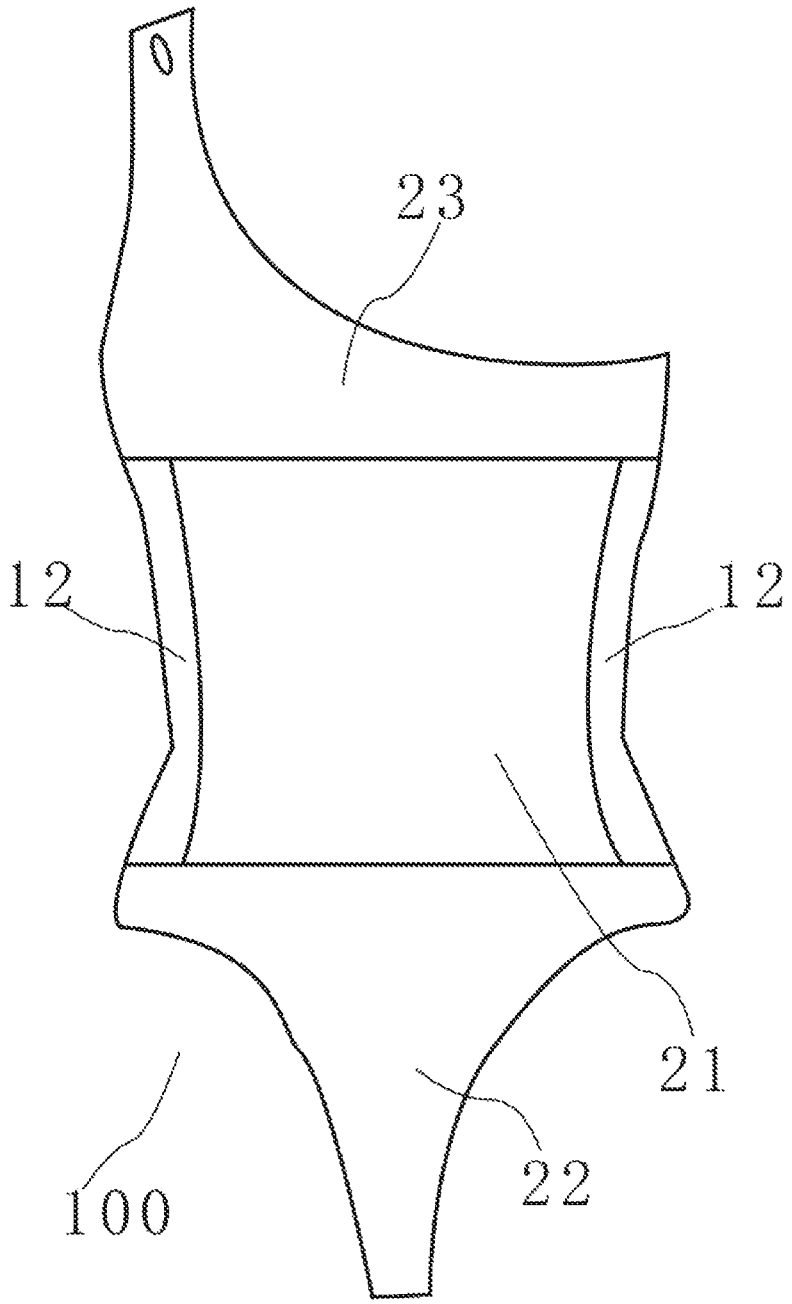
FIG. 21 is a schematic structural diagram of the back side of the lining fabric according to Embodiment 8 of the present invention.

This embodiment differs from Embodiment 6 described above only in that: as shown in FIGS. 20-21, the upper right end of the first lining and the upper right end of the third back lining are stitched and connected to form one shoulder strap; and the first front lining and the first back lining form a single-shoulder neck structure.

Embodiment 9

Figure 22:
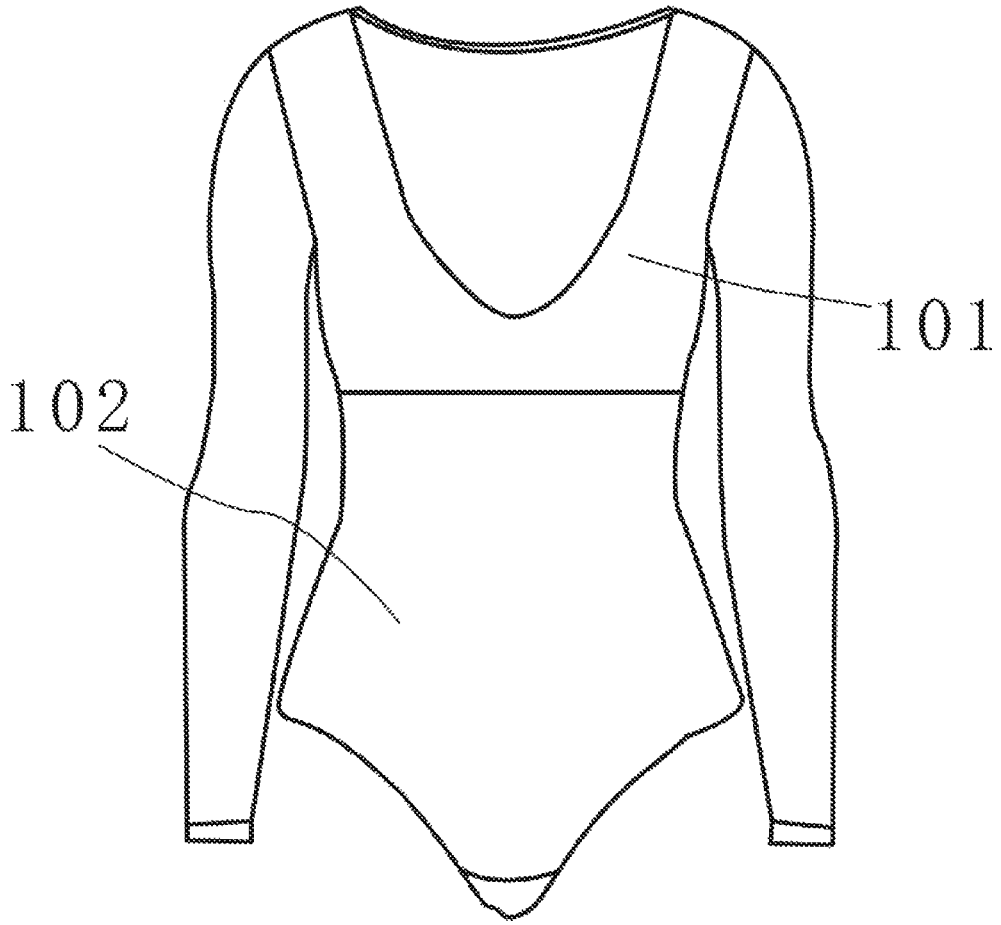
FIG. 22 is a schematic structural diagram of the front side of a shapewear according to Embodiment 9 of the present invention.
Figure 23:
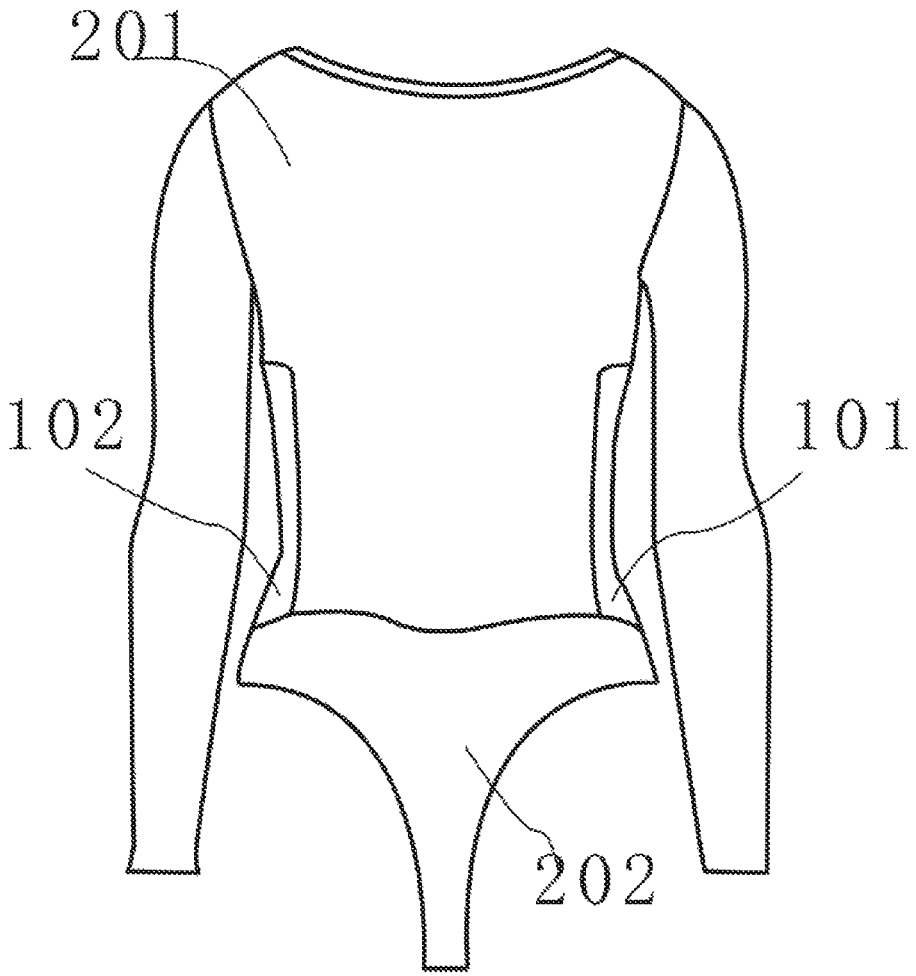
FIG. 23 is a schematic structural diagram of the back side of the shapewear according to Embodiment 9 of the present invention.

As shown in FIGS. 22-23, this embodiment provides a shapewear having the style of one-piece garment structure, including a first front piece 101, a second front piece 102, a first back piece 201, a second back piece 202, and sleeves.

The first front piece 101 is distributed corresponding to a region at and above the chest of a human body; the second front piece 102 is distributed corresponding to upper and lower belly regions (the upper belly located above the belly button, and the lower belly located below the belly button) below the chest of the human body; and the first front piece 101 is stitched and connected to an upward side of the second front piece 102 by means of elastic bands.

The first back piece 201 is distributed corresponding to back and waist regions of the human body; the second back piece 202 is distributed corresponding to a hip region of the human body; and the first back piece 201 is stitched and connected to the upward side of the second back piece 202 by means of four needle six lines.

An upper end of the first front piece 101 and an upper end of the first back piece 201 are stitched and connected to form shoulder seams; and left and right ends of the first front piece 101 and corresponding ends of the first back piece 201 are stitched and connected to form muffs, to which the sleeves are connected respectively. The first front piece 101 and the first back piece 201 form a deep V-neck structure at the neckline, and in some other embodiments, the first front piece 101 and the first back piece 201 may form a square or round neck structure at the neckline. Preferably, the first front piece 101 is made of a skin-fit fabric such as a cotton or modal fabric; and the first back piece 201 has an elastic mesh structure to form, in a wear state, a waist binding portion and a back flattening portion, which are connected together and can apply a binding-up force to the waist and back.

The second front piece 102 has a rubber elastic fabric structure to serve as a rubber shaping portion, and in this embodiment, the second front piece forms the belly binding portion of the shapewear.

In this embodiment, the left and right ends of the belly binding portion extend backwards to the back waist region by 2 cm-4 cm, respectively. That is, the suture between the second front piece 102 and the first back piece 201 is moved backwards by 2 cm-4 cm, thereby matching the first back piece 201 to shape the waist curves. Moreover, the rubber elastic fabric structure of the belly binding portion is utilized to extend the pressurizing and binding-up force to the back waist to keep the strength and time of the binding-up force on the waist.

The lower part of the second front piece 102 corresponding to the lower belly region has a front briefs piece structure; the second back piece 202 has a T-back back piece structure; and the left and right sides of the lower part of the second front piece 102 are stitched and connected to the corresponding sides of the second back piece 202 respectively to form leg openings. In some other embodiments, the second back piece 202 may also have a full hip wrapping structure. Preferably, the second back piece 202 is made of a skin-fit fabric such as a cotton or modal fabric. Further, to facilitate defecation, the second front piece 102 and the second back piece 202 are each provided at the bottom with a crotch opening, at which a bottom crotch cloth is provided detachably by a conventional manner such as snap fasteners.

Embodiment 10

Figure 24:
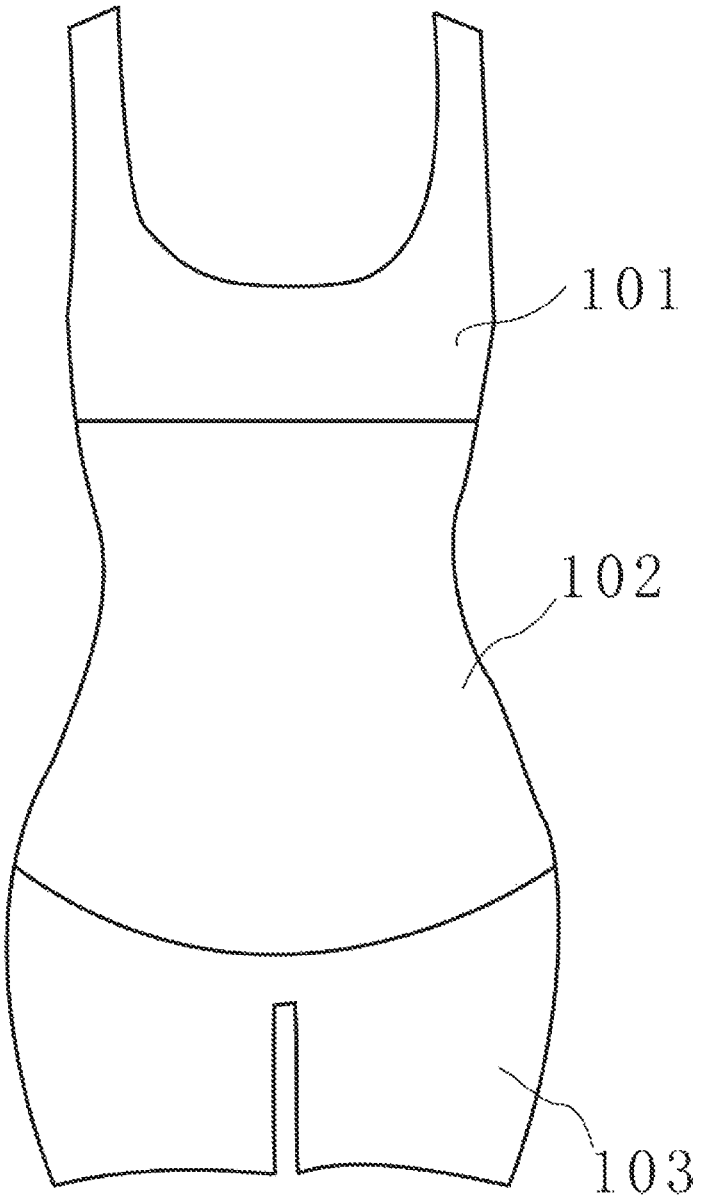
FIG. 24 is a schematic structural diagram of the front side of a shapewear according to Embodiment 10 of the present invention.
Figure 25:
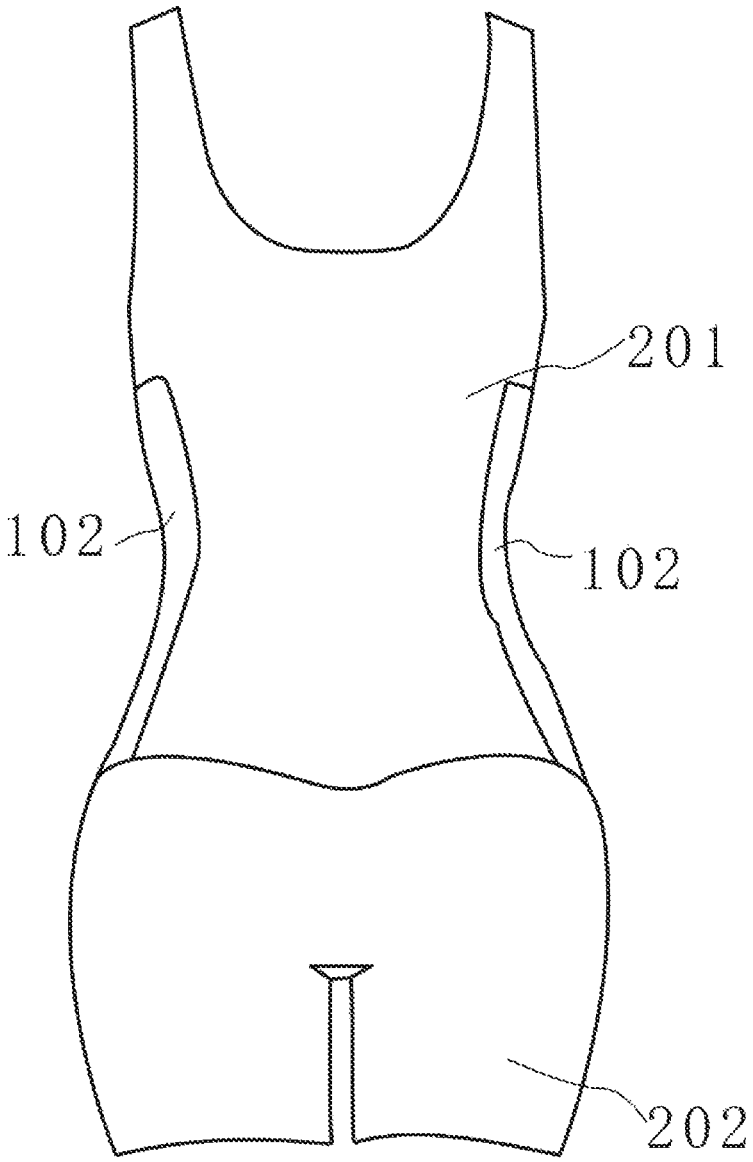
FIG. 25 is a schematic structural diagram of the back side of the shapewear according to Embodiment 10 of the present invention.

As shown in FIGS. 24-25, this embodiment provides a shapewear having the style of Siamese trousers structure, including a first front piece 10, a second front piece 102, a third front piece 103, a first back piece 201, and a second back piece 202.

The first front piece 101 is distributed corresponding to a region at and above the chest of a human body; the second front piece 102 is distributed corresponding to upper and lower belly regions (the upper belly located above the belly button, and the lower belly located below the belly button) below the chest of the human body; the third front piece 103 is distributed corresponding to thigh regions of the human body; the first front piece 101 is stitched and connected to an upward side of the second front piece 102 by means of elastic bands; and the third front piece 103 is stitched and connected to a lower side of the second front piece 102 by means of zigzag sewing.

The first back piece 201 is distributed corresponding to a region at and above the waist of the human body; the second back piece 202 is distributed corresponding to hip and thigh regions of the human body; and the first back piece 201 is stitched and connected to the upward side of the second back piece 202 by means of four needle six lines.

An upper end of the first front piece 101 and an upper end of the first back piece 201 are stitched and connected to form two suspenders; and left and right ends of the first front piece 101 and corresponding ends of the first back piece 201 are stitched and connected to form muffs. The first front piece 101 and the third back piece 201 form a suspender neck structure at a neckline. Preferably, the first front piece 101 is made of a skin-fit fabric such as a cotton or modal fabric; and the first back piece 201 has an elastic mesh structure to form, in a wear state, a waist binding portion and a back flattening portion, which are connected together and can apply a binding-up force to the waist and back.

The second front piece 102 has a rubber elastic fabric structure to serve as a rubber shaping portion, and in this embodiment, the second front piece forms the belly binding portion of the shapewear.

In this embodiment, the left and right ends of the belly binding portion extend backwards to the back waist region by 2 cm-4 cm, respectively. That is, the suture between the second front piece 102 and the first back piece 201 is moved backwards by 2 cm-4 cm, thereby matching the first back piece 201 to shape the waist curves. Moreover, the rubber elastic fabric structure of the belly binding portion is utilized to extend the pressurizing and binding-up force to the back waist to keep the strength and time of the binding-up force on the waist.

The lower part of the second front piece 102 corresponding to the lower belly region has an arc structure; the second back piece 202 has a boxer-brief back piece structure; and the left and right sides of the third front piece 103 are stitched and connected to the corresponding sides of the second back piece 202 respectively to form trousers legs. Preferably, the third front piece 103 and the second back piece 202 are both made of a skin-fit fabric such as a cotton or modal fabric. Further, to facilitate defecation, the third front piece 103 and the second back piece 202 are each provided at the bottom with a crotch opening, at which a bottom crotch cloth is provided detachably by a conventional manner such as snap fasteners.

Embodiment 11

Figure 26:
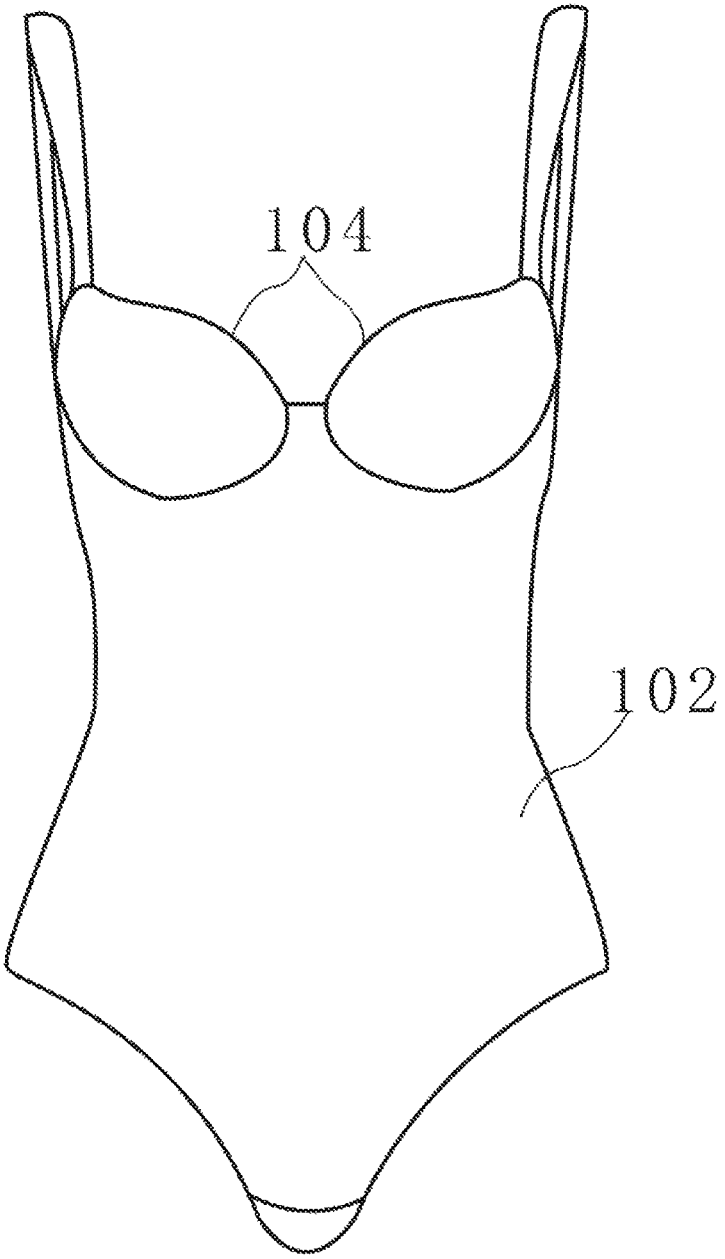
FIG. 26 is a schematic structural diagram of the front side of a shapewear according to Embodiment 11 of the present invention.
Figure 27:
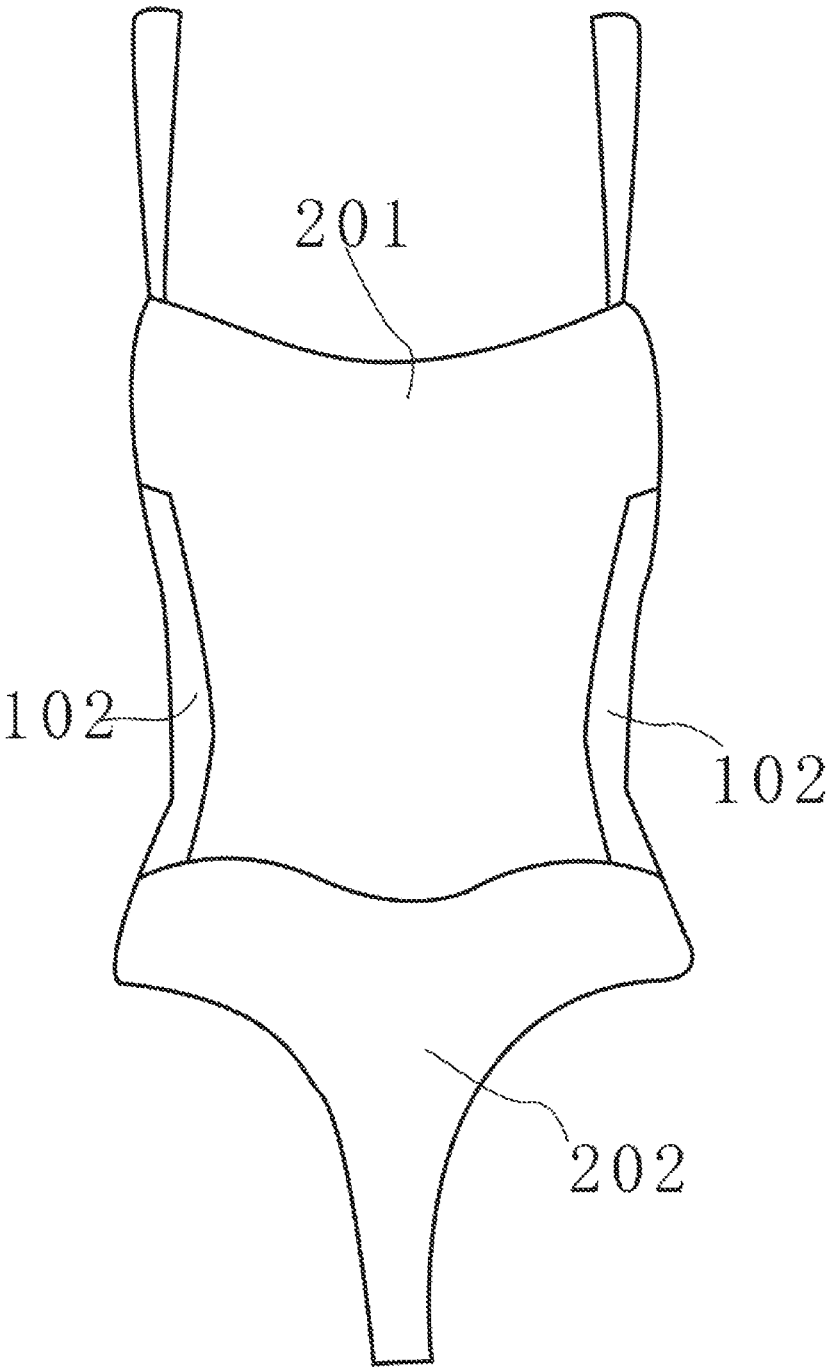
FIG. 27 is a schematic structural diagram of the back side of the shapewear according to Embodiment 11 of the present invention.

As shown in FIGS. 26-27, this embodiment provides a shapewear having the style of one-piece garment structure, including two mould cups 104, a second front piece 102, a first back piece 201, a second back piece 202, and two shoulder straps.

The mould cups 104 are distributed corresponding the chest region of the human body and are preferably ¾ mould cups; the second front piece 102 is distributed corresponding to upper and lower belly regions (the upper belly located above the belly button, and the lower belly located below the belly button) below the chest of the human body; and the second front piece 102 is stitched and connected to the lower sides of the mould cups 104 by means of elastic bands.

The first back piece 201 is distributed corresponding to back and waist regions of the human body; the second back piece 202 is distributed corresponding to a hip region of the human body; the first back piece 201 is stitched and connected to the upward side of the second back piece 202 by means of four needle six lines; and the two shoulder straps are stitched and connected to the upper ends of the mould cups 104 and the upper end of the first back piece 201, respectively. Preferably, the mould cups 104 and the shoulder straps are made of a skin-fit fabric such as a cotton or modal fabric; and the first back piece 201 has an elastic mesh structure to form, in a wear state, a waist binding portion and a back flattening portion, which are connected together and can apply a binding-up force to the waist and back.

The second front piece 102 has a rubber elastic fabric structure to serve as a rubber shaping portion, and in this embodiment, the second front piece forms the belly binding portion of the shapewear.

In this embodiment, the left and right ends of the belly binding portion extend backwards to the back waist region by 2 cm-4 cm, respectively. That is, the suture between the second front piece 102 and the first back piece 201 is moved backwards by 2 cm-4 cm, thereby matching the first back piece 201 to shape the waist curves. Moreover, the rubber elastic fabric structure of the belly binding portion is utilized to extend the pressurizing and binding-up force to the back waist to keep the strength and time of the binding-up force on the waist.

The lower part of the second front piece 102 corresponding to the lower belly region has a front briefs piece structure; the second back piece 202 has a T-back back piece structure; and the left and right sides of the lower part of the second front piece 102 are stitched and connected to the corresponding sides of the second back piece 202 respectively to form leg openings. Preferably, the second back piece 202 is made of a skin-fit fabric such as a cotton or modal fabric. Further, to facilitate defecation, the second front piece 102 and the second back piece 202 are each provided at the bottom with a crotch opening, at which a bottom crotch cloth is provided detachably by a conventional manner such as snap fasteners.

Embodiment 12

Figure 28:
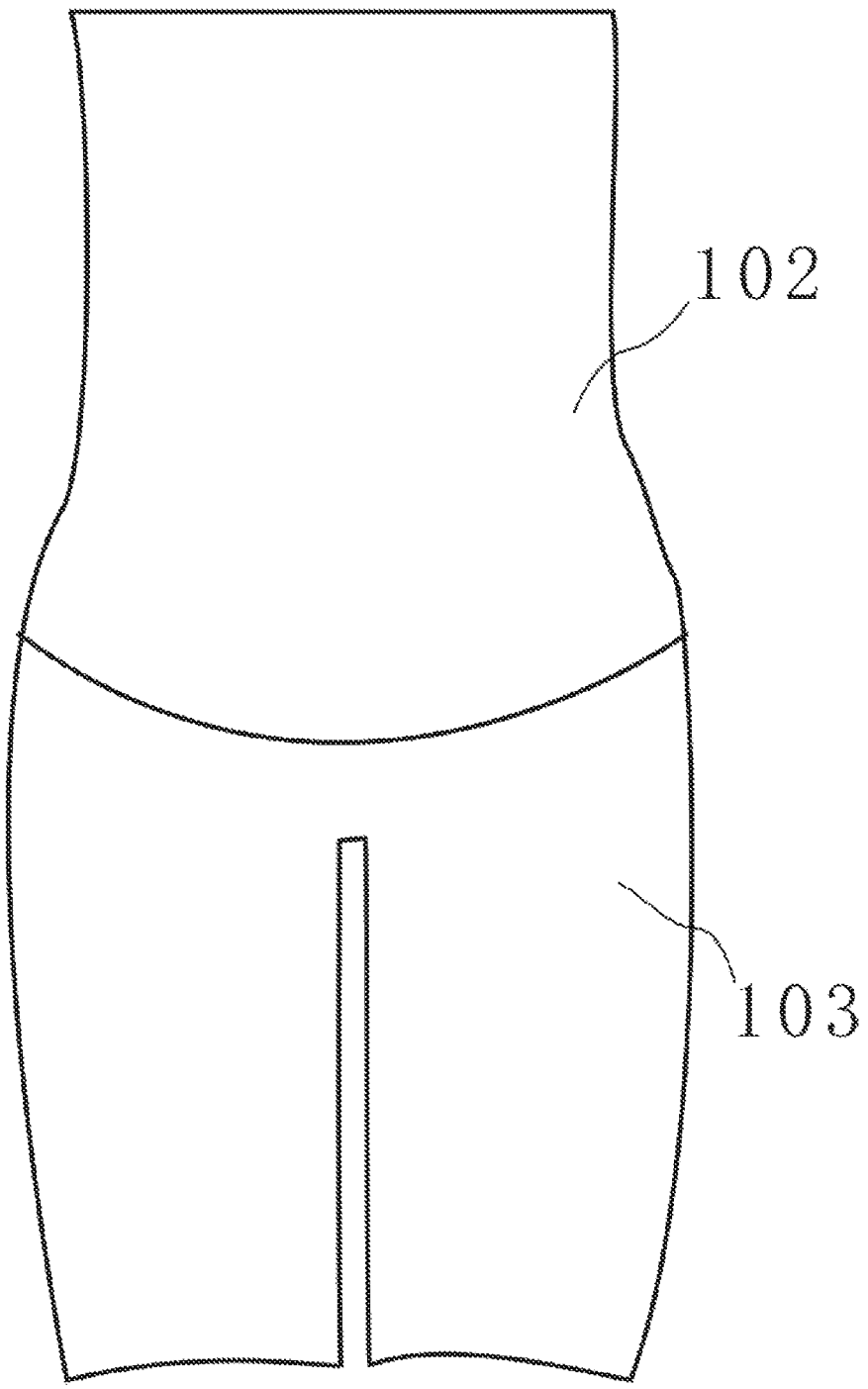
FIG. 28 is a schematic structural diagram of the front side of a shapewear according to Embodiment 12 of the present invention.
Figure 29:
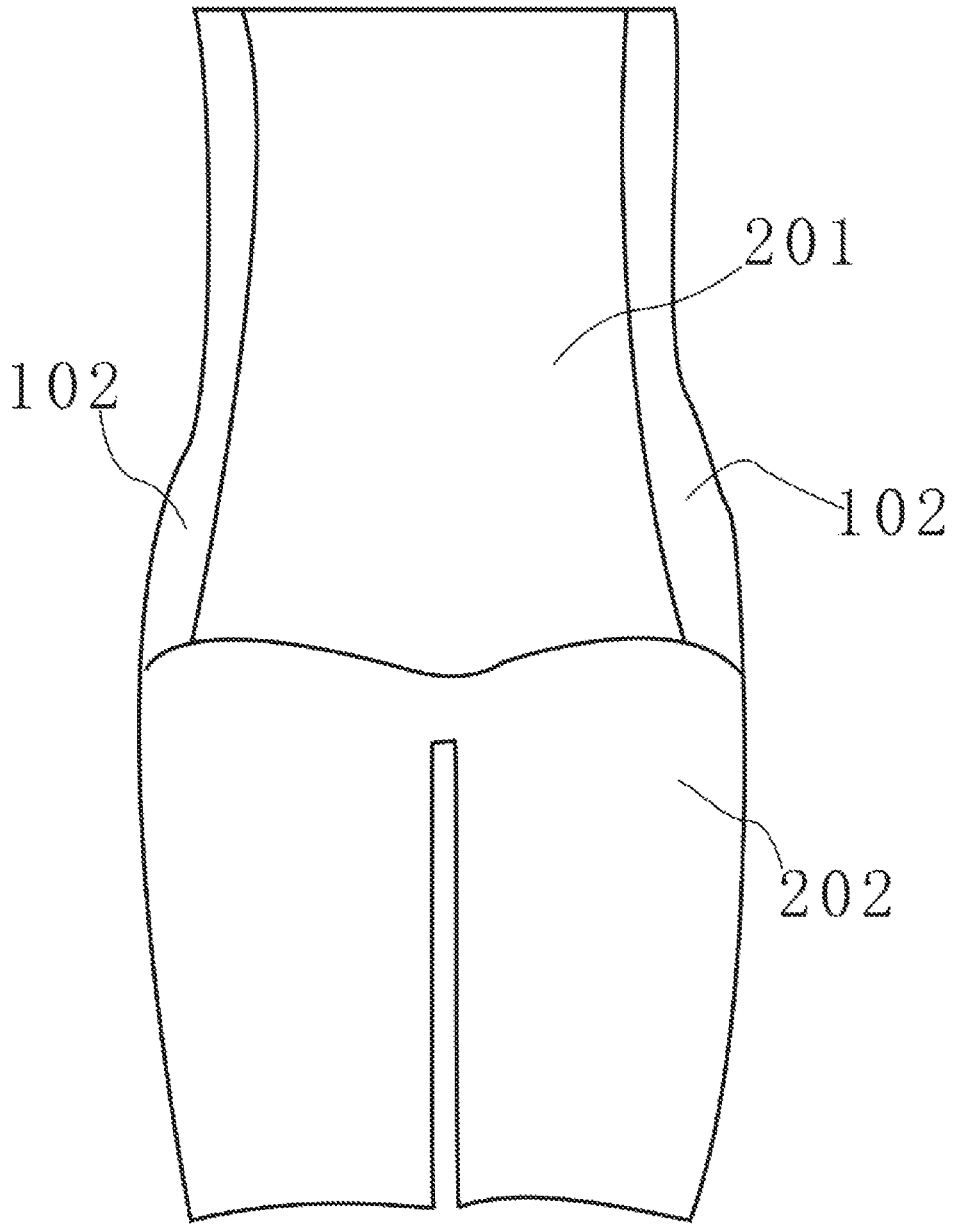
FIG. 29 is a schematic structural diagram of the back side of the shapewear according to Embodiment 12 of the present invention.

As shown in FIGS. 28-29, this embodiment provides a shapewear having the style of waist-shaping trousers structure, including a second front piece 102, a third front piece 103, a first back piece 201, and a second back piece 202. The waist-shaping trousers refer to trousers having waist positions higher than normal waist positions, and have a waist shaping portion covering the waist and belly of a human body. The waist height is designed as required, for example up to the lower chest or the belly button.

The second front piece 102 is distributed corresponding to upper and lower belly regions (the upper belly located above the belly button, and the lower belly located below the belly button) below the chest of the human body; the third front piece 103 is distributed corresponding to thigh regions of the human body; and the third front piece 103 is stitched and connected to a lower side of the second front piece 102 by means of zigzag sewing.

The first back piece 201 is distributed corresponding to a waist region of the human body; the second back piece 202 is distributed corresponding to hip and thigh regions of the human body; and the first back piece 201 is stitched and connected to the upward side of the second back piece 202 by means of four needle six lines.

The second front piece 102 has a rubber elastic fabric structure to serve as a rubber shaping portion, and in this embodiment, the second front piece forms the belly binding portion of the shapewear.

In this embodiment, the left and right ends of the belly binding portion extend backwards to the back waist region by 2 cm-4 cm, respectively. That is, the suture between the second front piece 102 and the first back piece 201 is moved backwards by 2 cm-4 cm, thereby matching the first back piece 201 to shape the waist curves. Moreover, the rubber elastic fabric structure of the belly binding portion is utilized to extend the pressurizing and binding-up force to the back waist to keep the strength and time of the binding-up force on the waist. The first back piece 201 has an elastic mesh structure to form, in a wear state, waist binding portions, which are connected together and can apply a binding-up force to the waist and back.

The lower part of the second front piece 102 corresponding to the lower belly region has an arc structure; the second back piece 202 has a fifth-pants back piece structure; and the left and right sides of the third front piece 103 are stitched and connected to the corresponding sides of the second back piece 202 respectively to form trousers legs. Preferably, the third front piece 103 and the second back piece 202 are both made of a skin-fit fabric such as a cotton or modal fabric. Further, to facilitate defecation, the third front piece 103 and the second back piece 202 are each provided at the bottom with a crotch opening, at which a bottom crotch cloth is provided detachably by a conventional manner such as snap fasteners.

Rubber Elastic Fabric Structure

The rubber elastic fabric structure in Embodiments 1-12 described above is a rubber elastic fabric layer resulting from vulcanization molding of a rubber mixing mixture and an elastic base fabric, with the thickness of 0.3 mm-0.6 mm; the elastic base fabric firmly binds to the rubber to achieve durability without binding failure after machine washing; and the rubber elastic fabric layer has a soft hand feel, and meanwhile, the feel of heaviness can be reduced to achieve an ultralight and ultrathin feel, while excellent tensile strength and tear strength can be maintained and the tensile elastic recovery can be improved. Therefore, the effect of pressurizing, stabilizing, and concentrating the fat can be achieved to flatten the fat at the belly, thereby achieving the effect of belly binding and significantly reducing shaping marks.

The rubber elastic fabric layer is provided with numerous air vents by means of punching or laser boring or the like to achieve breathability and comfort. The air vents are not limited in shape and aperture, and are preferably round, with the aperture of 0.5 mm-1.5 mm. The distribution density of the air vents is designed according to breathability requirements, and the spacing of 1 cm is preferred for the air vents.

The rubber mixing mixture in Embodiments 1 to 12 described above preferably consists of the following components in parts by weight: 20-50 parts of smoked sheet rubber #3, 40-60 parts of 3L rubber, 20-50 parts of CV60 constant-viscosity rubber, 5-15 parts of zinc oxide, 0.5-1.5 parts of stearic acid, 0.5-1.5 parts of polyethylene glycol, 2-10 parts of nano calcium carbonate, 3-5 parts of nano-kaolin, 5-15 parts of naphthenic oil, 0.5-2 parts of sulphur, and 1-2 parts of rubber promoter.

The above illustration and description provide the basic principles and main features as well as the advantages of the present invention. Those skilled in the industry should understand that the present invention is not limited by the embodiments described above. The embodiments described above and the description in the specification are merely for a purpose of explaining the principle of the present invention. There may be a variety of variations and improvements made to the present invention without departing from the inventive spirit and scope of the present invention. These variations and improvements shall fall within the scope claimed by the present invention. The scope claimed by the present invention are subject to the appended claims and equivalents thereof.

What is claimed is:

1. A shapewear having a rubber elastic fabric, wherein the shapewear comprises:

a shell fabric, a lining fabric covered by the shell fabric, and an intermediate fabric between the shell fabric and the lining fabric;

wherein the lining fabric and the intermediate fabric are both stitched and connected to an inside of the shell fabric to collectively form a one-piece dress structure; and the lining fabric comprises:

a first front lining configured to cover a region at and above a chest of a human body, a second front lining configured to cover upper and lower belly regions below the chest of the human body, a third front lining configured to cover thigh regions of the human body, a first back lining configured to cover a waist region of the human body, a second back lining configured to cover a back region of the human body, and a third back lining configured to cover hip and thigh regions of the human body;

wherein:

the first front lining is stitched and connected to an upward side of the second front lining;

the third front lining is stitched and connected to a lower side of the second front lining;

the first back lining is stitched and connected to an upward side of the third back lining and a lower side of the second back lining; and the second front lining has a rubber elastic fabric structure configured to apply a binding-up force to provide shaping to the shapewear.

2. The shapewear having the rubber elastic fabric according to claim 1, wherein the shell fabric has a mesh structure, and the intermediate fabric is used to cover the lining fabric to hide the lining fabric from view.

3. The shapewear having the rubber elastic fabric according to claim 1, wherein the first front lining is stitched and connected to the upward side of the second front lining by means of elastic bands.

4. The shapewear having the rubber elastic fabric according to claim 1, wherein the third front lining is stitched and connected to the lower side of the second front lining by means of zigzag sewing.

5. The shapewear having the rubber elastic fabric according to claim 1, wherein the first back lining is stitched and connected to the upward side of the third back lining and the lower side of the second back lining by means of four-needle flatlock stitching.

6. The shapewear having the rubber elastic fabric according to claim 1, wherein an upper end of the first front lining and an upper end of the first back lining are stitched and connected to form two suspenders.

7. The shapewear having the rubber elastic fabric according to claim 1, wherein left and right ends of the first front lining and corresponding ends of the second back lining are stitched and connected to form muffs of the lining fabric.

8. The shapewear having the rubber elastic fabric according to claim 1, wherein the first front lining and the second back lining form a suspender neck structure at a neckline of the lining fabric.

9. The shapewear having the rubber elastic fabric according to claim 1, wherein the first back lining has an elastic mesh structure to form, in a wear state, a waist binding portion capable of applying a binding-up force to the waist.

10. The shapewear having the rubber elastic fabric according to claim 1, wherein the second front lining forms a belly binding portion of the shapewear capable of applying a binding-up force to the belly.

11. The shapewear having the rubber elastic fabric according to claim 10, wherein left and right ends of the belly binding portion extend backwards to a back waist region.

12. The shapewear having the rubber elastic fabric according to claim 1, wherein a lower part of the second front lining corresponding to a lower belly region has an arc structure.

13. The shapewear having the rubber elastic fabric according to claim 1, wherein the third front lining has a front dress piece structure; the third back lining has a back dress piece structure; and left and right sides of the third front lining are stitched and connected to the corresponding sides of the third back lining respectively.

14. The shapewear having the rubber elastic fabric according to claim 1, wherein the shell fabric and the intermediate fabric each comprise a front garment piece and a back garment piece.

15. The shapewear having the rubber elastic fabric according to claim 14, wherein the shapewear further includes a first longitudinal rubber band sewn along a middle of the front garment piece of the shell fabric, a second longitudinal rubber band sewn along a middle of the first front lining, a third longitudinal rubber band sewn along a middle of the third front lining, a fourth longitudinal rubber band sewn along a middle of the second back lining, and a fifth longitudinal rubber band sewn along a middle of the third back lining.

16. The shapewear having the rubber elastic fabric according to claim 15, wherein side seams between the front and back garment pieces of the shell fabric are also sewn with longitudinal rubber bands.

17. The shapewear having the rubber elastic fabric according to claim 1, wherein the shell fabric and the intermediate fabric are stitched and connected to the lining fabric at side seams, middle seams, and necklines.

* * * * *